US008757156B2

(12) United States Patent
Martin et al.

(10) Patent No.: US 8,757,156 B2
(45) Date of Patent: Jun. 24, 2014

(54) FACE MASK WITH UNIDIRECTIONAL MULTI-FLAP VALVE

(75) Inventors: Philip G. Martin, Forest Lake, MN (US); Michael K. Domroese, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 788 days.

(21) Appl. No.: 12/250,059

(22) Filed: Oct. 13, 2008

(65) Prior Publication Data

US 2009/0133700 A1 May 28, 2009

Related U.S. Application Data

(60) Provisional application No. 60/990,348, filed on Nov. 27, 2007.

(51) Int. Cl.

| | |
|---|---|
| ***A62B 7/10*** | (2006.01) |
| ***A62B 23/02*** | (2006.01) |
| ***A62B 18/08*** | (2006.01) |

(52) U.S. Cl.

USPC ..... 128/206.15; 128/206.12; 128/205.29; 128/205.27

(58) Field of Classification Search

USPC ..... 128/206.15, 206.27, 206.28, 206.12, 128/200.24, 201.14, 205.24, 201.17, 128/205.27, 205.28, 205.29, 206.21, 128/206.23; 137/855, 512.15; 251/331

See application file for complete search history.

(56) References Cited

U.S. PATENT DOCUMENTS

| | | | | |
|---|---|---|---|---|
| 457,196 | A | 8/1891 | Grant | |
| 1,701,277 | A | 2/1929 | Shindel | |
| 2,072,516 | A | 3/1937 | Ferenci et al. | |
| 2,230,770 | A | 2/1941 | van Almelo | |
| 2,284,949 | A | 6/1942 | Cover | |
| 2,895,472 | A | 7/1959 | Matheson | |
| 4,536,440 | A | 8/1985 | Berg | |
| 4,576,196 | A | 3/1986 | Ross et al. | |
| D285,374 | S | 8/1986 | Huber et al. | |
| 4,630,604 | A | 12/1986 | Montesi | |
| 4,691,623 | A * | 9/1987 | Mizusawa | 454/164 |
| 4,790,306 | A | 12/1988 | Braun et al. | |
| 4,807,619 | A | 2/1989 | Dyrud et al. | |

(Continued)

FOREIGN PATENT DOCUMENTS

| | | |
|---|---|---|
| DE | 738391 | 8/1943 |
| EP | 0 143 618 A2 | 6/1985 |

(Continued)

OTHER PUBLICATIONS

ASTM E111-97.

(Continued)

*Primary Examiner* — Justine Yu
*Assistant Examiner* — Colin W Stuart
(74) *Attorney, Agent, or Firm* — Karl G. Hanson

(57) ABSTRACT

Face masks that include a unidirectional valve are disclosed. The unidirectional valves permit fluid communication between an interior gas space defined by the mask and the wearer and an exterior gas space outside of the face mask. The unidirectional valves includes one or more valve flaps positioned over an opening formed in the base of the valve. Each of the valve flaps includes a free edge and a hinge located generally opposite from the free edge.

26 Claims, 12 Drawing Sheets

(56) References Cited

U.S. PATENT DOCUMENTS

| | | | | |
|---|---|---|---|---|
| 4,827,924 | A | 5/1989 | Japuntich | |
| 4,850,347 | A | 7/1989 | Skov | |
| 4,873,972 | A | 10/1989 | Magidson et al. | |
| 4,934,632 | A | 6/1990 | Kim | |
| 4,971,052 | A | 11/1990 | Edwards | |
| 5,035,239 | A | 7/1991 | Edwards | |
| 5,050,594 | A | 9/1991 | Babb | |
| 5,062,421 | A | 11/1991 | Burns et al. | |
| 5,105,849 | A * | 4/1992 | Clough | 137/512.15 |
| 5,143,117 | A * | 9/1992 | Klein | 137/512.15 |
| 5,174,731 | A | 12/1992 | Korver | |
| D347,298 | S | 5/1994 | Japuntich et al. | |
| D347,299 | S | 5/1994 | Bryant et al. | |
| 5,325,892 | A | 7/1994 | Japuntich et al. | |
| 5,394,568 | A | 3/1995 | Brostrom et al. | |
| 5,464,010 | A | 11/1995 | Byram | |
| 5,509,436 | A | 4/1996 | Japuntich et al. | |
| 5,558,089 | A | 9/1996 | Castiglione | |
| 5,617,849 | A | 4/1997 | Springett et al. | |
| 5,673,690 | A | 10/1997 | Tayebi et al. | |
| 5,687,767 | A | 11/1997 | Bowers | |
| 5,924,420 | A | 7/1999 | Reischel et al. | |
| D412,573 | S | 8/1999 | Castiglione | |
| 5,941,244 | A | 8/1999 | Yamazaki | |
| 6,041,782 | A | 3/2000 | Angadjivand et al. | |
| 6,047,698 | A | 4/2000 | Magidson et al. | |
| D424,688 | S | 5/2000 | Bryant et al. | |
| 6,062,221 | A | 5/2000 | Brostrom et al. | |
| 6,123,077 | A | 9/2000 | Bostock et al. | |
| D431,647 | S | 10/2000 | Henderson et al. | |
| 6,125,849 | A | 10/2000 | Williams et al. | |
| 6,132,308 | A * | 10/2000 | Dietz et al. | 454/162 |
| 6,142,177 | A | 11/2000 | Jones | |
| D443,927 | S | 6/2001 | Chen | |
| 6,273,127 | B1 * | 8/2001 | Wade | 137/512.15 |
| 6,394,090 | B1 | 5/2002 | Chen et al. | |
| 6,425,413 | B2 | 7/2002 | Davis et al. | |
| 6,463,657 | B2 | 10/2002 | Hayakawa et al. | |
| 6,474,513 | B2 | 11/2002 | Burt | |
| 6,484,722 | B2 | 11/2002 | Bostock et al. | |
| 6,494,269 | B2 | 12/2002 | French et al. | |
| RE37,974 | E | 2/2003 | Bowers | |
| 6,540,573 | B2 | 4/2003 | Sato | |
| 6,568,392 | B1 | 5/2003 | Bostock et al. | |
| 6,604,524 | B1 | 8/2003 | Curran et al. | |
| 6,672,565 | B2 | 1/2004 | Russell | |
| 6,720,708 | B2 | 4/2004 | Athanas | |
| 6,721,435 | B2 | 4/2004 | Babb et al. | |
| 6,824,117 | B2 | 11/2004 | Horton | |
| 6,843,248 | B2 | 1/2005 | Japuntich et al. | |
| 6,854,463 | B2 | 2/2005 | Japuntich et al. | |
| 6,883,518 | B2 | 4/2005 | Mittelstadt et al. | |
| 6,923,182 | B2 | 8/2005 | Angadjivand et al. | |
| 6,959,709 | B2 | 11/2005 | Curran et al. | |
| 6,986,365 | B2 | 1/2006 | Henning et al. | |
| 7,007,695 | B2 | 3/2006 | Curran et al. | |
| 7,013,895 | B2 | 3/2006 | Martin et al. | |
| 7,028,689 | B2 | 4/2006 | Martin et al. | |
| 7,028,981 | B2 | 4/2006 | Horton | |
| 7,069,931 | B2 | 7/2006 | Curran et al. | |
| 7,117,868 | B1 | 10/2006 | Japuntich et al. | |
| 7,121,279 | B2 | 10/2006 | Dennis | |
| 7,131,442 | B1 | 11/2006 | Kronzer et al. | |
| RE39,493 | E | 2/2007 | Yuschak et al. | |
| 7,188,622 | B2 | 3/2007 | Martin et al. | |
| 7,503,326 | B2 | 3/2009 | Martin | |
| 7,556,559 | B2 * | 7/2009 | Rivera et al. | 454/162 |
| 2001/0002041 | A1 | 5/2001 | Hayakawa et al. | |
| 2001/0007284 | A1 | 7/2001 | French et al. | |
| 2001/0022194 | A1 | 9/2001 | Davis et al. | |
| 2001/0026626 | A1 | 10/2001 | Athanas | |
| 2001/0033673 | A1 | 10/2001 | Babb et al. | |
| 2001/0035220 | A1 | 11/2001 | Russell | |
| 2001/0039156 | A1 | 11/2001 | Sato | |
| 2002/0020721 | A1 | 2/2002 | Bonningue et al. | |
| 2002/0030068 | A1 | 3/2002 | Burt | |
| 2003/0205231 | A1 | 11/2003 | Shigematsu et al. | |
| 2004/0255947 | A1 | 12/2004 | Martin et al. | |
| 2005/0081921 | A1 * | 4/2005 | Blake et al. | 137/512.15 |
| 2007/0144524 | A1 | 6/2007 | Martin | |

FOREIGN PATENT DOCUMENTS

| | | | |
|---|---|---|---|
| EP | 0 143 618 | B1 | 6/1985 |
| EP | 0 737 489 | | 10/1996 |
| EP | 1820541 | A1 | 8/2007 |
| GB | 825659 | | 12/1959 |
| GB | 1 507 257 | | 4/1978 |
| JP | S42-000592 | B | 10/1965 |
| JP | S48-043766 | Y | 1/1969 |
| JP | S59-030942 | U | 8/1982 |
| JP | 2001-107867 | A | 4/2001 |
| JP | 2001-178837 | A | 7/2001 |
| JP | 2002-195184 | A | 7/2002 |
| JP | 2002-276584 | A | 9/2002 |
| JP | 2006-110273 | A | 10/2004 |
| NL | 49614 | | 11/1940 |
| WO | WO 93/24181 | A1 | 12/1993 |
| WO | WO 01/28634 | A1 | 4/2001 |

OTHER PUBLICATIONS

ASTM D412-98a.
ASTM D638-01.
ASTM D747-99.

* cited by examiner

FACE MASK WITH UNIDIRECTIONAL MULTI-FLAP VALVE

CROSS REFERENCE TO RELATED APPLICATION

This application claims the benefit of U.S. Provisional Patent Application No. 60/990,348, filed Nov. 27, 2007, the disclosure of which is incorporated by reference herein in its entirety.

The present invention provides face masks with a unidirectional valve for moving air between the interior of the face mask and the exterior of the face mask.

Persons who work in polluted environments commonly wear a face mask to protect themselves from inhaling airborne contaminants. To improve the exhausting of warm, moist exhaled air from the interior space of the face masks, manufacturers often install an exhalation valve to allow the warm, moist exhaled air to be rapidly purged from the mask interior. The rapid removal of the exhaled air makes the mask interior cooler, and, in turn, benefits worker safety because mask wearers are less likely to remove the mask from their face to eliminate the hot moist environment within the face mask.

For many years, commercial face masks have used "button-style" exhalation valves to purge exhaled air from mask interiors. The button-style valves typically have employed a thin circular flexible flap as the dynamic mechanical element that lets exhaled air escape from the mask interior. The flap is centrally mounted to a valve seat through a central post. Examples of button-style valves are shown in U.S. Pat. Nos. 2,072,516, 2,230,770, 2,895,472, and 4,630,604. When a person exhales, a circumferential portion of the flap is lifted from the valve seat to allow air to escape from the mask interior.

Button-style valves represented an advance in the attempt to improve wearer comfort, but investigators have made other improvements, an example of which is shown in U.S. Pat. No. 4,934,362 to Braun. The valve described in this patent uses a parabolic valve seat and an elongated flexible flap. Like the button-style valve, the Braun valve also has a centrally-mounted flap and has a flap edge portion that lifts from a seal surface during an exhalation to allow the exhaled air to escape from the mask interior.

After the Braun development, another innovation was made in the exhalation valve art by Japuntich et al.—see U.S. Pat. Nos. 5,325,892 and 5,509,436. The Japuntich et al. valve uses a single flexible flap that is mounted off-center in cantilevered fashion to minimize the exhalation pressure that is required to open the valve. When the valve-opening pressure is minimized, less power is required to operate the valve, which means that the wearer does not need to work as hard to expel exhaled air from the mask interior when breathing.

Other valves introduced after the Japuntich et al. valve also have used a non-centrally mounted cantilevered flexible flap—see U.S. Pat. No. 5,687,767 (reissued as U.S. Reissue Pat. No. RE37,974 E) and U.S. Pat. No. 6,047,698. Cantilevered valves that have this kind of construction are sometimes referred to as "flapper-style" exhalation valves. Further improvements relating to unidirectional valves as used in connection with respiratory face masks have also been described in U.S. Pat. Nos. 7,013,895; 7,028,689; and 7,188,622 (all to Martin et al.); as well as U.S. Patent Application Publication No. US 2007/0144524 (Martin).

SUMMARY OF THE INVENTION

The present invention provides face masks that include a unidirectional valve. The unidirectional valves permit fluid communication between an interior gas space defined by the mask and the wearer and an exterior gas space outside of the face mask.

In some embodiments, the unidirectional valves used in connection with the present invention may include a diaphragm that includes two or more valve flaps formed in the same diaphragm, with each of the valve flaps being positioned over an opening formed in the base of the valve. Each of the valve flaps includes a free edge and a hinge located generally opposite from the free edge. The valve flap may be described as being attached to the diaphragm along the hinge.

In other embodiments, the unidirectional valves used in connection with the present invention may include two or more valve flaps that are arranged such that the two or more valve flaps open in the same direction such that air (or any other gas) passed through such a set of valve flaps is predisposed to flow in a common direction. In such an arrangement, the valve flaps may be described as being oriented in the same direction such that the free edge of one valve flap is located adjacent the hinge of the other valve flap and wherein the hinges of the two or more valve flaps are generally parallel to each other.

In still other embodiments, the unidirectional valves used in connection with the present invention may include a valve flap located over an opening, wherein the valve flap includes a stationary portion attached to the valve base and a movable portion, with a hinge located between the stationary portion and the movable portion. The valve flap includes a closed position in which the valve flap contacts a seal surface to close the opening, and the valve flap also has an open position in which the movable portion of the valve flap is lifted off of the seal surface such that gas may pass between the interior gas space and the exterior gas space of a face mask. The hinge of the valve flap preferably includes one or more hinge slots formed through the valve flap and one or more land portions through which the movable portion of the valve flap is connected to the stationary portion of the valve flap, wherein the one or more hinge slots are located outside of the seal surface when the valve flap is in the closed position.

In use, each valve flap of the unidirectional valves used in connection with the present invention includes a closed position in which the valve flap contacts a seal surface around a perimeter of the opening to close the opening against flow in one direction, and an open position in which at least a portion of the valve flap is lifted off of the seal surface such that gas (e.g., air) can pass through the opening in the opposite direction.

One potential advantage of at least some embodiments of the present invention is that the use of multiple, i.e., two or more, valve flaps (optionally in a single diaphragm) can provide a unidirectional valve with a relatively low profile without presenting an unacceptable pressure drop. In contrast, conventional "flapper-style" valves typically include a single flap located over a single orifice through which air passes. As a result, the single flap must open to a significant degree to allow enough air to pass through the valve without resulting in an unacceptable pressure drop across the valve. A unidirectional valve of the present invention may preferably include a valve height (i.e., a height above the surrounding mask body surface) that is one-half or less of the valve height of a conventional flapper-style valve (to achieve an equivalent pressure drop in a valve that occupies an equivalent area on the surface of the mask body).

Among the potential advantages that may be associated with at least some low profile unidirectional valves of the present invention are: a reduced susceptibility to damage because the lower profile valve is less likely to be damaged due to unwanted contact with objects, etc.; improved visibility for the wearer because vision across the mask may be improved; improved resistance to incursion of particulates from, e.g., grinding or other processes that produce particulates capable of passing upstream through an open valve (because, e.g., the open spaces of the valve flaps are smaller); etc.

Because the unidirectional valves of some embodiments of the present invention may include multiple valve flaps, the profile of the valves may be further reduced (in at least some embodiments) by curving the base, diaphragm, and cover such that the valve as a whole follows the contour shape of the mask body more closely. In spite of such curvature, however, the function of each valve flap may be maintained by orienting the seal surfaces in different directions along the curvature of the valve.

Still another potential advantage of the unidirectional valves is that manufacturing may be simplified because the diaphragm or diaphragms in which the valve flaps are formed may need only be retained in place over the openings without requiring physical attachment of the diaphragm to the base (through, e.g., welding, fitting over posts, adhesives, etc.).

In one aspect, the present invention provides a face mask that includes a mask body adapted to fit over at least the nose and mouth of a person to help define an interior gas space when worn. The face mask also includes a unidirectional valve that permits fluid communication between the interior gas space and an exterior gas space. The unidirectional valve includes a base attached to the mask body, the base having two or more openings through which gas may pass between the interior gas space and the exterior gas space. Each opening of the two or more openings is surrounded by a seal surface that extends around the opening. A stationary diaphragm is positioned on the base and the diaphragm extends over the two or more openings and their respective seal surfaces. Two or more valve flaps are formed within the diaphragm, wherein one valve flap of the two or more valve flaps is located over each opening of the two or more openings. Each valve flap of the two or more valve flaps includes a boundary slot formed through the diaphragm and a hinge along which the valve flap is attached to the diaphragm. The boundary slot defines a free edge of the valve flap, and the boundary slot extends from a first end to a second end. The hinge extends between the first end and the second end of the free edge of the valve flap. Each valve flap of the two or more valve flaps has a closed position in which the valve flap contacts the seal surface that extends around the opening over which the valve flap is located to close the opening. Each valve flap also has an open position in which at least a portion of the valve flap is lifted off of the seal surface such that gas may pass between the interior gas space and the exterior gas space.

In various embodiments, the face masks described above may also include one or more of the following features: the free edge of each valve flap of the two or more valve flaps may be defined by a boundary slot that has a slot width such that the free edge of the valve flap is spaced from an opposing edge of the diaphragm across the boundary slot; the hinge may include a score line formed into the diaphragm; each hinge may include one or more hinge slots formed through the diaphragm, and one or more land portions connecting the valve flap to the diaphragm; the two or more valve flaps located over the two or more openings may be oriented in the same direction such that the free edge of one valve flap is located adjacent the hinge of the other valve flap and the hinges of the valve flaps may be generally parallel to each other; each seal surface may be a planar seal surface, and the planar seal surfaces that extend around each opening of the two or more openings may be located in the same plane or in different planes; each valve flap of the two or more valve flaps may be biased or unbiased against its seal surface when in the closed position; the seal surface that extends around each opening of the two or more openings may be a resilient seal surface; the mask body may be a filtering mask body; the unidirectional valve may be an exhalation valve; etc.

The unidirectional valves may also include a cover attached to the base, with the diaphragm located between the cover and the base. Any such cover may include a vent structure for each opening of the two or more openings, with each vent structure defining a distinct flow path through the cover for gas passing through each of opening of the two or more openings. For each valve flap in the diaphragm, the vent structure may include a louver with an edge positioned to retain the diaphragm in proximity with the base. Each vent structure may include a main vent located opposite the opening and a side vent located to one side of the opening.

In another aspect, the present invention may provide a face mask that includes a mask body adapted to fit over at least the nose and mouth of a person to help define an interior gas space when worn and a unidirectional valve that permits fluid communication between the interior gas space and an exterior gas space. The unidirectional valve may include a base attached to the mask body. The base may include two or more openings through which gas may pass between the interior gas space and the exterior gas space, and each opening of the two or more openings may be surrounded by a seal surface that extends around the opening. A valve flap may be located over each opening of the two or more openings. Each valve flap may include a stationary portion and a movable portion, with a hinge located between the stationary portion and the movable portion. Each valve flap has a free edge extending around the movable portion of the valve flap outside of the hinge. Each valve flap has a closed position in which the movable portion of the valve flap contacts the seal surface that extends around the opening over which the valve flap is located to close the opening, and each valve flap also has an open position in which the movable portion of the valve flap is lifted off of the seal surface such that gas may pass between the interior gas space and the exterior gas space. The valve flaps located over the two or more openings may be oriented in the same direction such that the free edge of one valve flap is located adjacent the hinge of the other valve flap and wherein the hinges of the valve flaps are generally parallel to each other.

In various embodiments, the face masks described above may include one or more of the following features: the hinge may include a score line formed into the diaphragm; the hinge of a valve flap may include one or more hinge slots formed through the valve flap, and one or more land portions through which the movable portion of the valve flap is connected to stationary portion of the valve flap; each seal surface may be a planar seal surface, and the planar seal surfaces that extend around each opening of the two or more openings may be located in the same plane or in different planes; each valve flap of the two or more valve flaps may be biased or unbiased against its seal surface when in the closed position; the seal surface that extends around each opening of the two or more openings may be a resilient seal surface; the mask body may be a filtering mask body; the unidirectional valve may be an exhalation valve; etc.

The unidirectional valve may include a cover attached to the base, wherein the valve flaps are located between the cover and the base, and the cover may include a vent structure for each opening of the two or more openings, and further wherein each vent structure may define a distinct flow path through the cover for gas passing through each of opening of the two or more openings. For each valve flap, the vent structure may include a louver with an edge positioned to retain the valve flap in proximity with the base. Each vent structure may also include a main vent located opposite the opening and a side vent located to one side of the opening.

In another aspect, the present invention may provide a face mask that includes a mask body adapted to fit over at least the nose and mouth of a person to help define an interior gas space when worn, and a unidirectional valve that permits fluid communication between the interior gas space and an exterior gas space. The unidirectional valve may include a base attached to the mask body. The base may include an opening through which gas may pass between the interior gas space and the exterior gas space. The opening may be surrounded by a seal surface that extends around the opening. A valve flap is located over the opening, and the valve flap may include a stationary portion and a movable portion, with a hinge located between the stationary portion and the movable portion. The valve flap has a closed position in which the valve flap contacts the seal surface to close the opening. The valve flap also has an open position in which the movable portion of the valve flap is lifted off of the seal surface such that gas may pass between the interior gas space and the exterior gas space. The hinge includes one or more hinge slots formed through the valve flap and one or more land portions through which the movable portion of the valve flap is connected to the stationary portion of the valve flap. The hinge slots are located outside of the seal surface when the valve flap is in the closed position.

In various embodiments, the face masks described above may include one or more of the following features: the hinge slots may be arranged along a straight line; the seal surface may be a planar seal surface; the valve flap may be biased or unbiased against its seal surface when in the closed position; the seal surface may be a resilient seal surface; the mask body may be a filtering mask body, the unidirectional valve may be an exhalation valve; etc.

GLOSSARY

The terms used to describe this invention will have the following meanings:

"a," "an," "the," "at least one," and "one or more" are used interchangeably (thus, for example, a unidirectional valve that includes a diaphragm can include one or more diaphragms);

"and/or" means one or all of the listed elements or a combination of any two or more of the listed elements;

"cantilever bend ratio" means the ratio of deflection to cantilever length as defined in connection with the Cantilever Bend Ratio test described herein;

"clean air" means a volume of air or oxygen that has been filtered to remove contaminants or that otherwise has been made safe to breathe;

"closed position" means the position where the valve flap is in full contact with the seal surface;

"contaminants" mean particles and/or other substances that generally may not be considered to be particles (e.g., organic vapors, et cetera) but may be suspended in air;

"exhaled air" is air that is exhaled by a filtering face mask wearer;

"exhale flow stream" means the stream of air that passes through an orifice of an exhalation valve during an exhalation;

"exhalation valve" means a valve that opens to allow a fluid to exit a face mask's interior gas space;

"exterior gas space" means the ambient atmospheric gas space into which exhaled gas enters after passing through and beyond an exhalation valve;

"face mask" means a device (including half and full face masks and hoods) that covers at least the nose and mouth of a wearer and is capable of providing clean air to the wearer by filtering the air or otherwise providing clean air;

"valve flap" means an element that is capable of bending or flexing in response to a force exerted from a moving fluid, which moving fluid, in the case of an exhalation valve, would be an exhale flow stream and in the case of an inhalation valve would be an inhale flow stream;

"flexural modulus" means the ratio of stress to strain for a material loaded in a bending mode;

"inhale flow stream" means the stream of air or oxygen that passes through an orifice of an inhalation valve during an inhalation;

"inhalation valve" means a valve that opens to allow a fluid to enter a filtering face mask's interior gas space;

"interior gas space" means the space between a mask body and a person's face;

"mask body" means a structure that can fit at least over the nose and mouth of a person and that helps define an interior gas space separated from an exterior gas space;

"modulus of elasticity" means the ratio of the stress to the strain for the straight line portion of the stress/strain curve that is obtained by applying an axial load to a test specimen and measuring the load and deformation simultaneously through use of a tensile testing machine;

"monolayer" as used in connection with valve flaps means that the flap structure is substantially compositionally uniform throughout its volume, that is, the valve flap does not include two or more layers that exhibit different physical properties;

"particles" mean any liquid and/or solid substance that is capable of being suspended in air, for example, pathogens, bacteria, viruses, mucous, saliva, blood, etc.;

"preferred" and "preferably" refer to embodiments of the invention that may afford certain benefits, under certain circumstances (other embodiments may also be preferred, under the same or other circumstances, and the recitation of one or more preferred embodiments does not imply that other embodiments are not useful, and is not intended to exclude other embodiments from the scope of the invention);

"resilient" means being able to recover if deformed in response to a flexural force and having a tensile modulus less than about 15 MegaPascals (MPa);

"rigid" as used to describe a seal surface means a seal surface with a hardness that is greater than 0.02 Giga Pascals (GPa);

"seal surface" means a surface that makes contact with the flexible flap when the valve is in its closed position;

"stiff or stiffness" means the flap's ability to resist deflection when supported horizontally as a cantilever by itself without support from other structures and exposed to gravity. A stiffer flap does not deflect as easily in response to gravity as a flap that is not as stiff;

"unidirectional fluid valve" means a valve that allows a fluid to pass through it in one direction but not the other; and "unbiased" as used in connection with a valve flap means that the flap is not pressed towards or against the seal surface by virtue of any mechanical force or internal stress that is placed on the flexible flap;

The above summary is not intended to describe each embodiment or every implementation of the present invention. Rather, a more complete understanding of the invention will become apparent and appreciated by reference to the following Description of Exemplary Embodiments of the Invention and claims in view of the accompanying figures of the drawing.

BRIEF DESCRIPTIONS OF THE FIGURES

Exemplary embodiments of the present invention will be further described with reference to the views of the drawing as briefly described below.

DESCRIPTION OF EXEMPLARY EMBODIMENTS OF THE INVENTION

Figure 1:
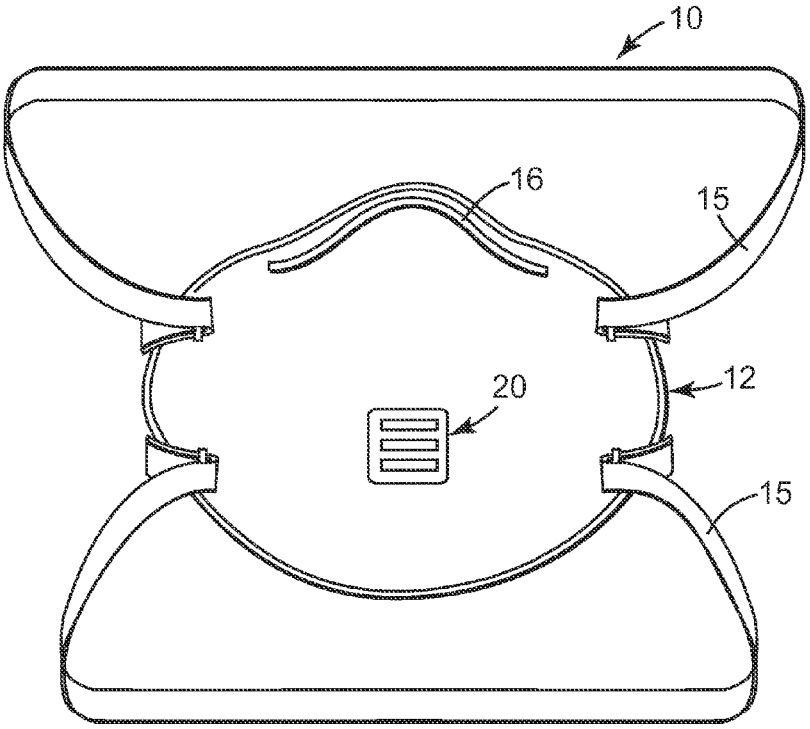
FIG. 1 is a front view of one exemplary face mask 10 that may be used in connection with the present invention.

In the following detailed description of exemplary embodiments of the invention, reference is made to the accompanying figures of the drawing which form a part hereof, and in which are shown, by way of illustration, specific embodiments in which the invention may be practiced. It is to be understood that other embodiments may be utilized and structural changes may be made without departing from the scope of the present invention.

Although the face masks and unidirectional valves used in connection with them may be described herein as operating to control air movement, the face masks and unidirectional valves may alternatively be used with gases other than air. For simplicity, however, the exemplary embodiments discussed herein will be described in connection with air.

FIG. 1 illustrates one example of a half face mask 10 that may be used in conjunction with the present invention. Face mask 10 has a cup-shaped mask body 12 onto which a unidirectional valve 20 is attached. The valve may be attached to the mask body 12 using any suitable technique, including, for example, the technique described in U.S. Pat. No. 6,125,849 to Williams et al. or in WO 01/28634 to Curran et al.

The unidirectional valves of the present invention provide the ability to control flow into and out of the interior gas space defined by the face mask 10 when fitted over the nose and mouth of a wearer. The exemplary unidirectional valves may be described herein as primarily exhalation valves, but it should be understood that the same structures can also function as inhalation valves. If used as an exhalation valve, the valve 20 preferably opens in response to increased pressure inside the mask 10 (in the interior gas space), which increased pressure occurs when a wearer exhales. The exhalation valve 20 preferably remains closed between breaths and during an inhalation. If used as an inhalation valve, the valve 20 preferably opens when the wearer inhales (creating a low pressure condition in the interior gas space). As an inhalation valve, the valve 20 would then preferably close between breaths and during exhalation.

Figure 2:
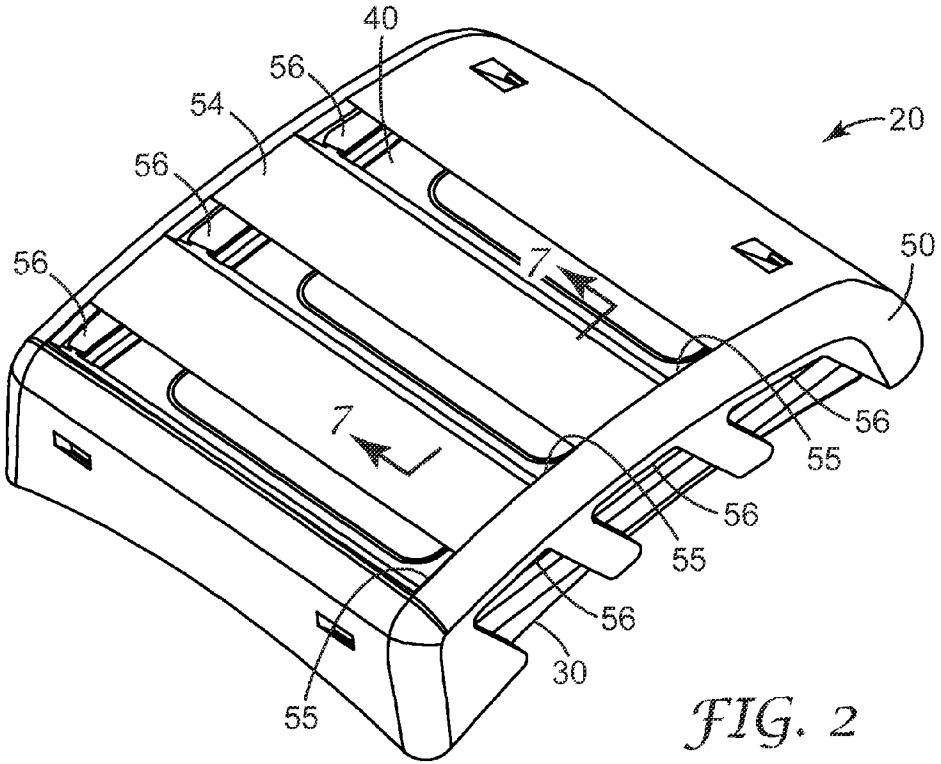
FIG. 2 is an enlarged perspective view of one exemplary unidirectional valve of the present invention.
Figure 3:
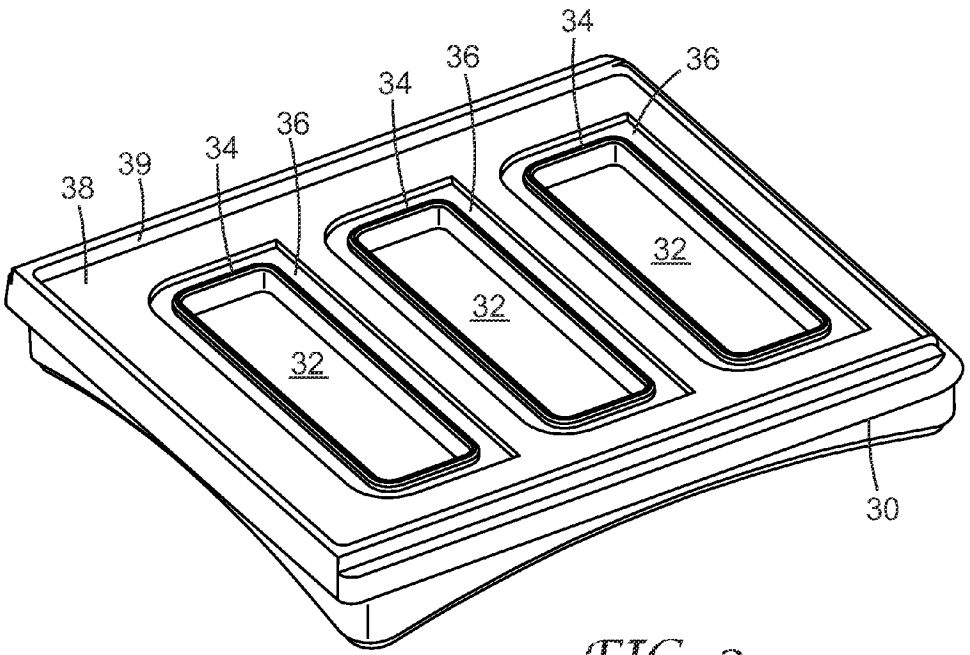
FIG. 3 is an enlarged perspective view of the base of the unidirectional valve of FIG. 2 with the cover and diaphragm removed to expose the base of the valve.
Figure 4:
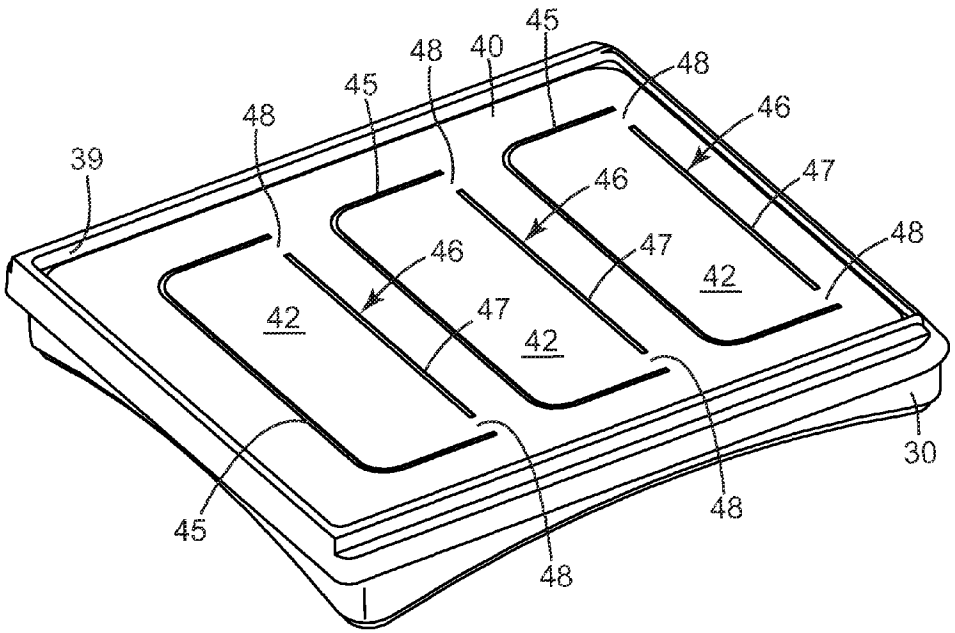
FIG. 4 is an enlarged perspective view of the unidirectional valve of FIG. 2 with the cover removed to expose the diaphragm on the base, wherein the valve flaps are in the closed position.

One embodiment of the valve 20 on mask 10 is depicted in more detail in FIGS. 2-4, where FIG. 2 is an enlarged perspective view of the unidirectional valve 20 removed from the mask 10, which includes a base 30, stationary diaphragm 40 and cover 50 attached to the base 30. FIG. 3 is an enlarged perspective view of the base 30 of the unidirectional valve 20 with the diaphragm 40 and the cover 50 removed to expose the base 30 of the valve 20. FIG. 4 is an enlarged perspective view of the unidirectional valve 20 with the cover 50 removed to expose the diaphragm 40 and its associated valve flaps 42 located between the base 30 and the cover 50 of the valve 20. The base 30 and cover 50 may preferably be manufactured from relatively lightweight plastic that may preferably be molded into one-piece integral bodies.

The base 30 of the valve 20 includes three openings 32 in a surface 38 through which air passes between the interior gas space defined by the mask 10 and the exterior gas space. The surface 38 may preferably be surrounded by a lip 39 such that the surface 38 and the lip 39 form a depression in which a diaphragm (see below) is located. The three openings 32 are preferably separate and distinct from each other, although the base 30 itself may be located over a single unitary opening (not shown) provided in the mask body 12. Alternatively, the mask body 12 may include separate and distinct openings corresponding to the openings 32 formed in the base 30. Although not depicted in the embodiment of FIG. 3, the openings 32 may optionally include one or more cross members to stabilize the opening shape, prevent the valve flaps from passing through the opening, etc.

Although the depicted valve 20 includes three valve flaps 42 and associated openings 32, it should be understood that a diaphragm in the unidirectional valves of the present invention that includes multiple valve flaps formed therein may include as few as two valve flaps or four or more valve flaps, and that the three valve flaps 42 depicted in connection with valve 20 is only one exemplary embodiment. In some embodiments, the valves of the present invention may include two or more separate diaphragms.

Each of the openings 32 is preferably surrounded by a separate and distinct seal surface 34 that surrounds the perimeter of the opening 32. The seal surface 34 provides a surface against which a valve flap seals as described herein. The base 30 may also preferably include a depression 36 that surrounds the seal surface 34, the depression 36 sitting below the level of the surrounding surface 38 of the base 30.

Each opening 32 and its seal surface 34 can take on essentially any shape when viewed from the front as seen in FIG. 3. For example, the seal surface 34 and the opening 32 may be square, rectangular, circular, elliptical, etc. The shape of seal surface 34 does not have to correspond to the shape of opening 32 or vice versa. For example, the opening 32 may be square and the seal surface 34 may be circular. The seal surfaces 34 and the openings 32 may, however, preferably have a generally rectangular cross-section when viewed against the direction of fluid flow.

Figure 5:
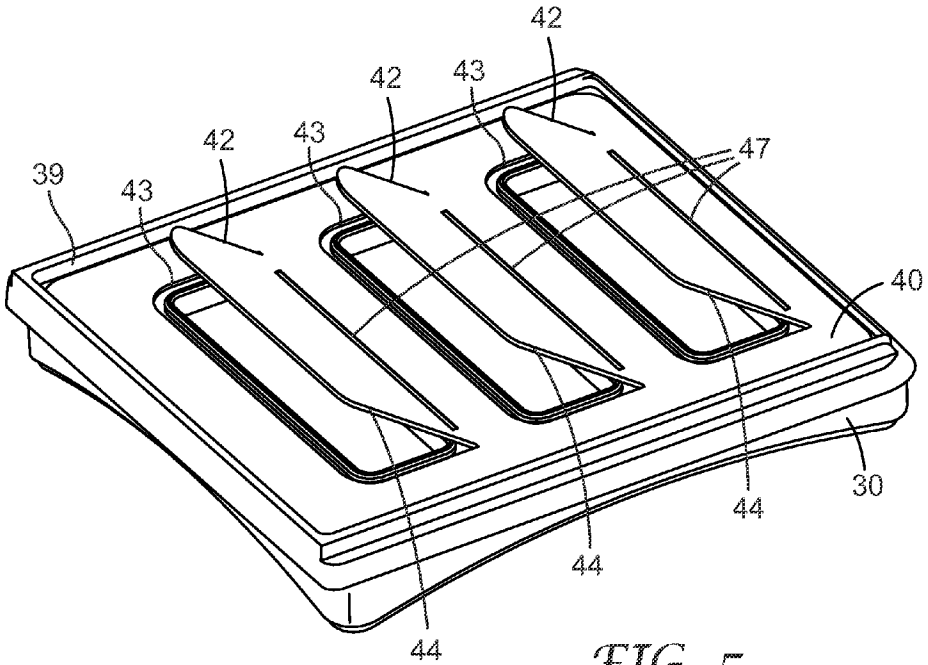
FIG. 5 is a view of FIG. 4 with the valve flaps in the open position.

The stationary diaphragm 40, as depicted in FIGS. 4 & 5, includes a set of separate and distinct valve flaps 42 formed therein, with one of the valve flaps 42 located over each opening 32 in the base 30. Each of the valve flaps 42 includes a free edge 44 formed though the thickness of the diaphragm 40. In the depicted embodiment, the free edge 44 is defined by a boundary slot 45 formed through the diaphragm 40. Each of the valve flaps 42 also includes a hinge 46 located opposite the free edge 44. The hinge 46 may be characterized as being located in an area of the diaphragm 40 at which the valve flap 42 is attached to the remainder of the diaphragm 40.

In some embodiments, the diaphragm 40 may be larger than valve flaps 42 formed therein as depicted in FIG. 4. In particular, the valve flaps 42 may include free edges 44 that are located opposite from opposing edges 43 in the diaphragm 40. In addition, it should be noted that the boundary slot 45 (which, in the depicted embodiment, defines the free edges 44 of the valve flaps 42 and the opposing edges 43 of the diaphragm 40) may have any suitable width. For example, in some embodiments, the boundary slot 45 may have virtually no width and in other embodiments that boundary slot 45 may be formed with a width substantially larger than that depicted in FIG. 4.

In the view of FIG. 4, each of the valve flaps 42 is depicted in the closed position in which the valve flap 42 contacts the seal surface 34 around the perimeter of its respective opening 32. As such, the valve flaps 42 (as defined by the free edges 44 and hinges 46) are preferably larger than the seal surface 34 that extends around the perimeter of each opening 32. The valve flaps 42 are depicted in the open position in FIG. 5. In the open position, at least a portion of each valve flap 42 (including the free edges 44) is lifted from the seal surface 34 such that air can pass from the interior gas space to the exterior gas space through the openings 32 and through the gaps located between the valve flaps 42 and the seal surfaces 34. It may be preferred that at least a portion of the valve flaps 42 on one side of the hinges 46 remain in contact with the base 30 when the valve flaps 42 are in the open position.

In another manner of characterizing the valve flaps 42, they may be described as having a stationary portion and a movable portion, with the stationary portion of the valve flap 42 remaining fixed or stationary (with respect to the base 30) during use and the movable portion moving to allow air to pass through the valve. In at least some embodiments, the hinge 46 may be positioned at least generally at a location that separates the stationary portion of the valve flap 42 from the movable portion of the valve flap 42.

The seal surface 34 that makes contact with the valve flap 42 is preferably fashioned to be substantially uniformly smooth to ensure that a good seal occurs between the seal surface 34 and the valve flap 42. The seal surface 34 may preferably be in planar alignment (i.e., lie in the same plane) with the remainder of the base surface 38 that surrounds the seal surface 34. The seal surface 34 preferably has a width great enough to form a seal with the valve flap 42, but is not so wide as to allow adhesive forces—caused, for example, by condensed moisture or expelled saliva—make the valve flap 42 significantly more difficult to open. Some potentially suitable seal surface geometries may be described in U.S. Pat. Nos. 5,509,436 and 5,325,892 to Japuntich et al.

In one manner of characterizing the valve flaps 42, the boundary slots 45 (and the corresponding free edges 44 of the valve flaps 42) may be described as having a first end and a second end, with the hinge 46 being located between the first end and the second end of the boundary slots 45 (and corresponding free edges 44). The boundary slots 45 (and corresponding valve flap free edges 44) may also be described as extending in two-dimensions across the major surfaces of the diaphragm 40. As a result, the boundary slots 45 (and corresponding valve flap free edges 44) define the shape of the valve flaps 42 in conjunction with the hinges 46.

Although not necessarily required, the hinges 46 may include hinge slots 47 that extend across the back of the valve flaps 42. The hinge slots 47 are preferably formed through the thickness of the diaphragm 40 and may preferably extend across the width of the valve flaps 42 with the exception of land portions 48 that remain attached to the valve flaps 42 and that retain the valve flaps 42 in attachment with the diaphragm 40. The ratio of the length of the hinge slot 47 to the land portions 48 may be adjusted to increase or decrease the force required to open the valve flap 42.

The diaphragm 40 may be retained in stationary position on the base 30 with the valve flaps 42 located over the openings 32 by any suitable technique or combination of techniques. In the depicted embodiment, the diaphragm 40 is held in position by the cover 50 and the base 30. In particular, it may be preferred that the base 30 include a base surface 38 and a lip 39 surrounding the base surface 38 such that the diaphragm 40 lays within the depression defined by the surface 38 and the lip 39. Alternatively (or in addition), the diaphragm 40 may be welded, adhesively attached, attached to posts, clamped, etc.

One example of a potentially suitable material for diaphragms and valve flaps is a 36 micrometer thick sheet of polyethylene terephthalate (PET) film with a modulus of elasticity of 3790 MPa in which the boundary slots 45 and hinge slots 47 are formed using a laser. The boundary slots 45 and the hinge slots 47 may have a width of, e.g., about 0.1 to about 0.3 millimeters. As formed, the land portions 48 may preferably occupy approximately 17% of the distance between the ends of the boundary slot 45, with the hinge slot 47 occupying the remainder of the width of the hinge 46.

Figure 6:
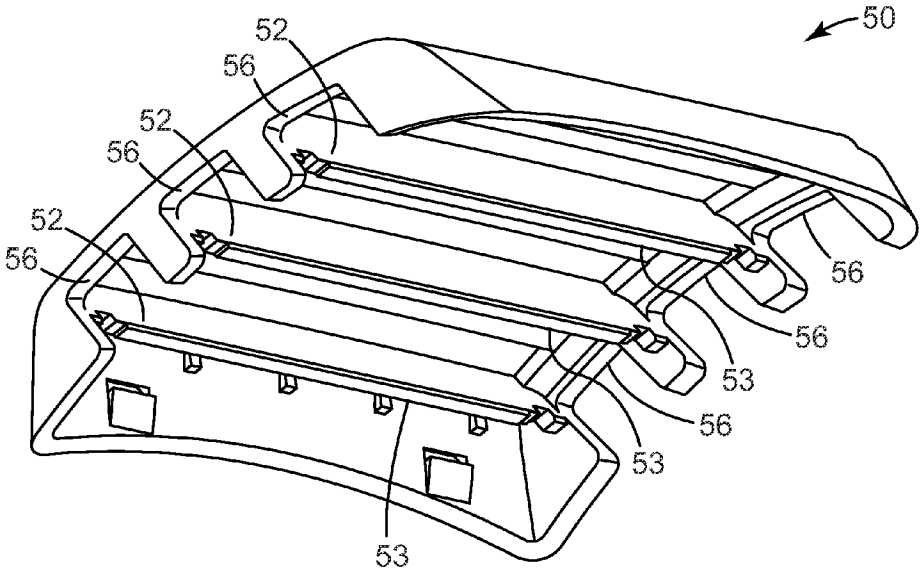
FIG. 6 is a perspective view of the cover of the unidirectional valve of FIG. 2 taken from the underside of the valve.

FIG. 6 is a perspective view of the underside of the cover 50 where the underside is that side that faces the base when the cover is assembled with the base as depicted in FIG. 2. The cover 50 preferably includes louvers 52 that extend downward from the main vents 55 in the cover 50 towards the base 30 and a diaphragm 40 located therebetween. The cover 50 also includes optional side vents 56 extending along two opposing sides of the cover 50, the side vents 56 providing additional flow paths for air to escape from the valve 20.

The cover 50 may be attached to the base 30 (see FIG. 2) by any suitable technique or combination of techniques. The cover 50 may be attached to the base 30 using welded connections, adhesively, mechanical interlocking connections (e.g., tabs, slots, posts, etc.), friction fit connections, etc. Although the cover 50 depicted in FIG. 6 is a separate article from the base 30, the cover 50 could alternatively be provided attached to the base 30 by, e.g., a living hinge or other structure. In such an arrangement, it may be preferred that the base 30 and cover 50 form a clamshell structure in which the diaphragm 40 is positioned before assembling the cover 50 to the base 30 to form the valve 20.

Figure 7:
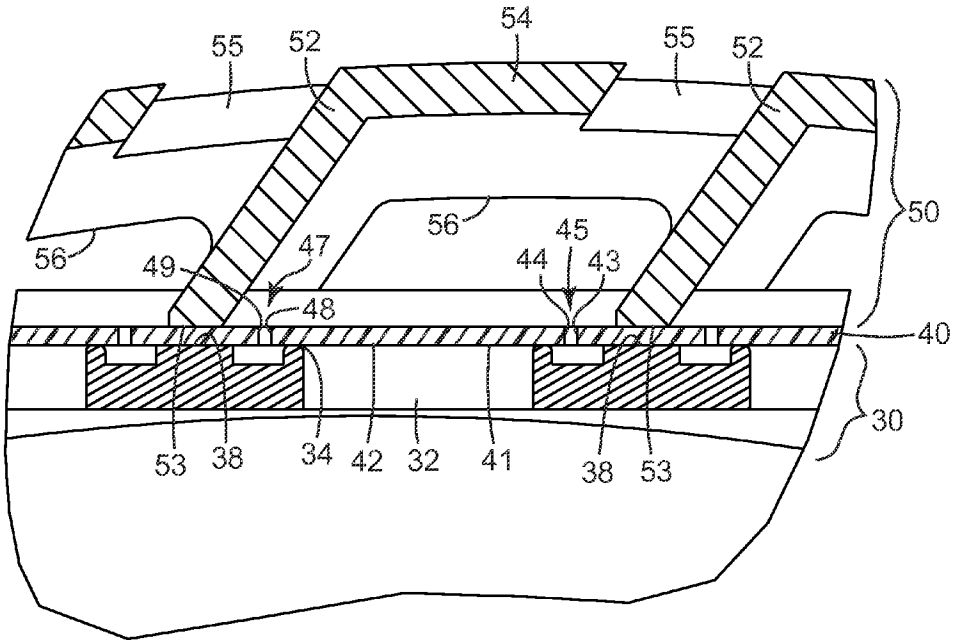
FIG. 7 is an enlarged cross-sectional view of a portion of the unidirectional valve of FIGS. 2-6 taken along line 7-7 in FIG. 2, wherein the valve flap is in the closed position.
Figure 8:
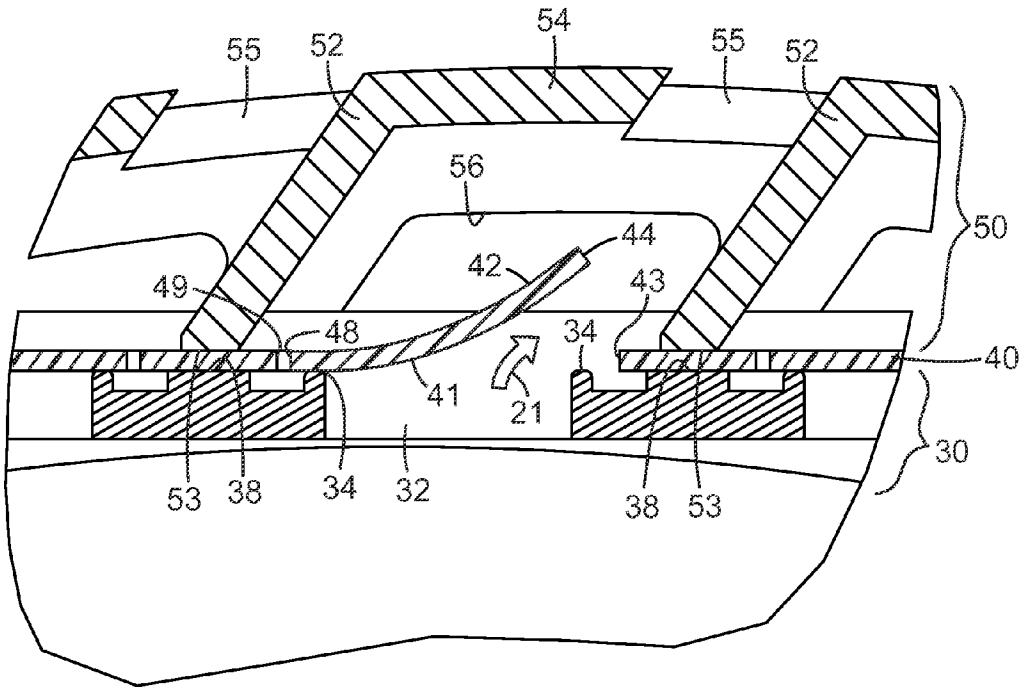
FIG. 8 is a view of FIG. 7 with the valve flap in the open position.

Additional features and operation of the valve flaps will now be described in connection with the enlarged cross-sectional views of a portion of the valve 20 as depicted in FIGS. 7 & 8. The valve flap 42 as depicted in FIG. 7 is in the closed position in which the surface 41 of the valve flap 42 is in contact with the seal surface 34. The remainder of the diaphragm 40 is located against the surrounding surface 38 of the base 30. As depicted in FIG. 8, the valve flap 42 is in the open position in which a portion of the surface 41 of the valve flap 42 is lifted off of the seal surface 34 such that air can pass through the opening 32 (in the general direction of arrow 21 in FIG. 8).

As seen in FIGS. 7 & 8, the louvers 52 may preferably be used to retain the diaphragm 40 in position on the base 30 as described herein by acting on the diaphragm along their edges 53. It may be preferred that the louvers 52 be constructed such that the edges 53 of the louvers 52 are spaced from the base surface 38 by a distance that is substantially equivalent to the thickness of the diaphragm 40. It may be preferred that the clearance between the edges 53 of the louvers 52 and the base surface 38 be such that the diaphragm 40 is not significantly compressed between the edges 53 and the base surface 38 such that it could deform. Such deformation could inhibit proper seating of the valve flaps on the seal surfaces.

As depicted in FIG. 7, the free edge 44 of the valve flap 42 is defined by the boundary slot 45. The boundary slot 45 may preferably have a slot width that provides clearance such that the free edge 44 of the valve flap 42 is spaced from the opposing edge 43 of the diaphragm 40. The slot width of the boundary slot 45 may preferably be large enough such that the free edge 44 of the valve flap 42 does not contact the opposing edge 43 of the diaphragm 40 when the valve flap 42 moves between the open and closed positions (seen in FIGS. 7 & 8).

Because the boundary slot 45 preferably has a slot width to limit interference between the free edge 44 and the opposing edge 43, it may be preferred that the valve flaps 42 be formed in the diaphragm 40 by any technique that is capable of providing that clearance. Examples of some potentially suitable techniques include molding or casting the flaps into the diaphragm as formed. In other alternatives, the flaps may be formed in the diaphragm using techniques such as, e.g., laser slitting, die cutting, water jet cutting, electron discharge machining, etc.

FIG. 7 also depicts the relationship between the hinge slot 47 and the diaphragm 40. The hinge slot 47 may preferably also have a slot width that provides clearance such that the hinge edge 48 of the valve flap 42 is spaced from the opposing edge 49 of the diaphragm 40. The slot width of the hinge slot 45 may preferably be large enough such that the hinge edge 48 of the valve flap 42 does not contact the opposing edge 49 of the diaphragm 40 when the valve flap 42 moves between the open and closed positions. The hinge slots 47 may be provided by any suitable technique used for the boundary slots 45 (e.g., molding, casting, laser slitting, die cutting, water jet cutting, electron discharge machining, etc.).

The unidirectional valves of the present invention may take any suitable shape or size depending on a variety of factors such as, e.g., acceptable pressure drop, air flow rates, etc. Some exemplary dimensions for the generally rectangular valve depicted in FIGS. 1-8 may be as follows. The cover 50 and base 30 may occupy an area on the mask body 12 with a width of about 10 millimeters to about 100 mm. The length of the area occupied by the valve on the mask body 12 may be about 10 mm to about 100 mm. The openings 55 in the cover may also take any acceptable shape or size, e.g., the openings 55 may be rectangular with a width from about 5 mm to about 90 mm and a length of about 1 mm to about 20 mm. The openings 32 in the base 30 may also be generally rectangular, with dimensions ranging from a width of about 4 mm to about 80 mm and a length of about 1 mm to about 30 mm. The valve flaps used to cover the openings are, as described herein, slightly larger than the openings they cover such that proper closure of the openings can be obtained.

The hinges 46 depicted in the valves of FIGS. 2-8 are only one exemplary embodiment of hinges that may be used in connection with the present invention. Depending on the physical properties of the material used to construct the diaphragm, a hinge may form naturally between the ends of the boundary slot that defines the free edge of the valve flap without the addition of structure to define the hinge. For example, if the diaphragm is made of a more flexible material (e.g., elastomeric polymers, etc.), no additional hinge structure may be required for the valve flaps to move from the closed to open positions at a low enough cracking pressure. In other words, in some materials, the valve flap hinges may be formed along a line extending between the ends of the free edge/boundary slot defining the shape of the valve flap.

Figure 9A:
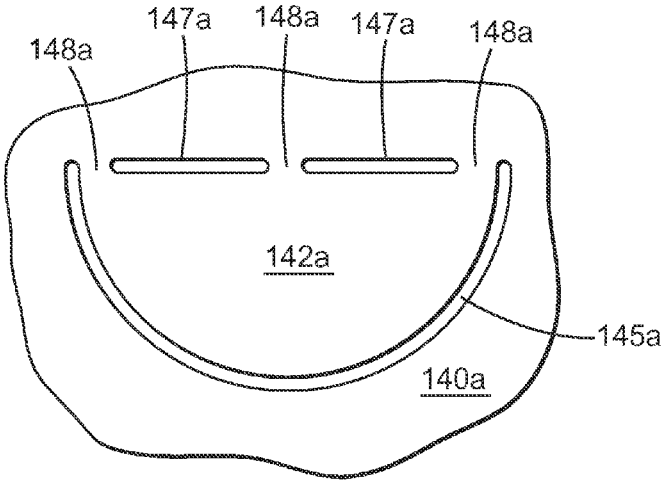
FIG. 9A is a plan view of one alternative valve flap in a diaphragm.

In other (typically stiffer) materials, it may be advantageous to provide some structure in the diaphragm to define the hinges that can act to reduce the force required to move the valve flaps from the closed to open positions. Although one example of some potentially suitable hinge structure is depicted in FIGS. 4 & 7, other structures may also be used. One potential alternative is depicted in FIG. 9A, where the valve flap 142*a* includes a pair of hinge slots 147*a* that, together with the boundary slot 145*a*, define three land portions 148*a* that connect the valve flap 142*a* to the surrounding diaphragm 140*a*.

Figure 9B:
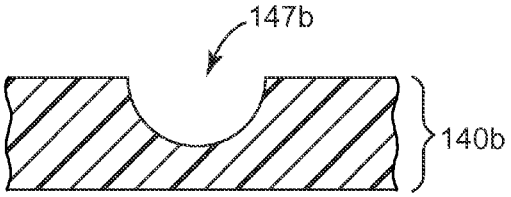
FIG. 9B is a cross-sectional view of a score line that may be used in the hinge of valve flap.

Still another alternative hinge structure is depicted in FIG. 9B which is a cross-sectional view taken across a hinge. The hinge structure depicted in FIG. 9B is in the form of a score line 147*b* formed into the diaphragm 140*b*. The score line 147*b* reduces the thickness of the diaphragm 140*b*, but does not extend completely through the diaphragm 140*b*. Such a score line may or may not extend over the entire distance between the ends of a free edge/boundary slot used to form a valve flap. In other words, the length, depth, and/or width of the score line may be adjusted to provide the desired opening characteristics for an associated valve flap. In addition, one or more score lines may be used as needed and/or one or more score lines may be used in a land portion to control the opening force of the valve flaps.

Returning to the cross-sectional views of FIGS. 7 & 8, a variety of features associated with the cover 50 are also depicted therein. For example, FIGS. 7 & 8 depict the arrangement in which the edges 53 of louvers 52 act against the diaphragm 40 to preferably assist in retaining the diaphragm 40 in contact with the surface 38 of the base 30. In some embodiments the louvers 52 may provide a compressive force on the diaphragm 40 in conjunction with the surface 38 of base 30. In other embodiments, however, the louvers 52 may not actually provide such a compressive force, but may simply restrain the diaphragm 40 from lifting significantly from the surface 38 of base 30. In addition, it may be preferred that the edge 53 of the louver 52 acts on the diaphragm 40 outside of the hinge slot 47 such that the louver 52 does not prevent movement of the valve flap 42 during opening.

It may also be preferred that the covers used in valves of the present invention include vent structures that define distinct flow paths through the cover 50 for air passing through the opening 32. In the embodiment depicted in FIGS. 7 & 8, for example, the distinct flow path is defined by louvers 52 which effectively isolate the flow through each opening 32 from the flow passing through any adjacent openings (not shown in FIGS. 7 & 8). The flow through opening 32 is forced, by louvers 52 and upper surface 54, to pass through the main vent 55 or the optional side openings 56.

As seen in FIGS. 7 & 8, the upper surface 54 of cover 50 may preferably extend over a significant portion of the valve flap 42 such that the main vent 55 is limited in size. The relationship between the main vent 55 and the valve flap 42 when in the open position may advantageously operate to block particles traveling upstream (against the airflow) through the opening 32. Such particles may be effectively blocked by impacting the louver 52, upper surface 54 of cover 50 and/or the upper surface or free edge of the valve flap 42.

Although the valve flaps 42 of the valve 20 depicted in FIGS. 2-8 are oriented in the same direction (see, for example, FIG. 4) such that the valve flap hinges are generally parallel to each other, such an arrangement is not required. One potential advantage of orienting the valve flaps in the same direction is that, when open, all of the valve flap openings face the same direction such that air passing through the open valve flaps is generally passed in the same direction—for example, away from the eyes of a wearer.

Figure 10:
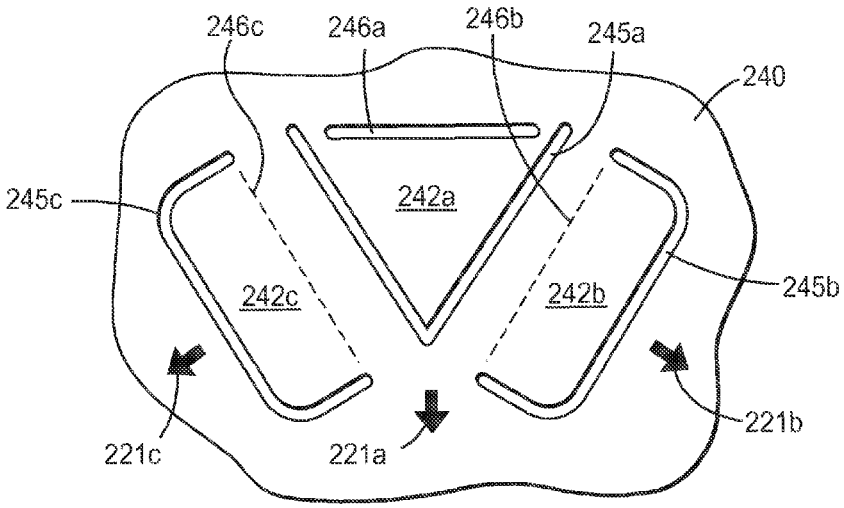
FIG. 10 is a plan view of an alternative diaphragm with differently shaped valve flaps oriented in different directions.

FIG. 10 depicts one alternative arrangement in which valve flaps with different shapes and valve flaps oriented in different directions may be used. The diaphragm 240 depicted in FIG. 10 includes three valve flaps 242*a*, 242*b*, 242*c*. Valve flap 242*a* is generally triangularly shaped and is defined by the hinge boundary slot 245*a* and the hinge 246*a*. The depicted hinge 246*a* is in the form of a slot formed in the diaphragm 240, although any other hinge structure (or no specific hinge structure at all in some embodiments) may be used in place of a slot. In view of the arrangement of the hinge 246*a* relative to the valve flap 242*a*, a significant portion of the air passing through the valve flap 242*a* may pass generally in the direction of arrow 221*a*.

The valve flaps 242*b* and 242*c* have a generally rectangular shape that differs from the triangular shape of valve flap 242*a*. In addition, the hinges 246*b* and 246*c* along which the valve flaps 242*b* and 242*c* are attached to the diaphragm 240 are not generally parallel with each other or with the hinge 246*a* of valve flap 242*a*. The free edges of the valve flaps 242*b* and 242*c* are defined, respectively, by boundary slots 245*b* and 245*c*. As such, when the valve flaps 242*b* and 242*c* move into the open position, a significant portion of the air passing through the valve flaps 242*b* and 242*c* may pass generally in the direction of arrows 221*b* and 221*c*, respectively.

Although FIG. 10 depicts one exemplary alternative collection of valve flaps that may be used in connection with the present invention, many other variations may also be possible and the invention should not be limited to those specific exemplary arrangements depicted herein. Also, although the valves may be described as including a diaphragm, it should be understood that the valves may be provided with more than one diaphragm, at least one of which includes two or more valve flaps as described herein.

The valve flaps formed in diaphragms of the present invention may or may not be biased against the seal surfaces surrounding the openings in the bases of the valves. In the valve 20 described in connection with FIGS. 2-8, the seal surfaces 34 surrounding the openings 32 in the base 30 may be described as having a planar shape. In other words, the surface of the seal surfaces 34 against which the valve flaps 42 rest when in the closed position lie in a plane (with the corresponding surface 41 of the valve flap 42 also typically lying in a plane). In order for valves with planar seal surfaces to provide acceptable seals, it may be preferred that one or both of the valve flap and the seal surface include resilient materials as discussed herein.

Figure 11:
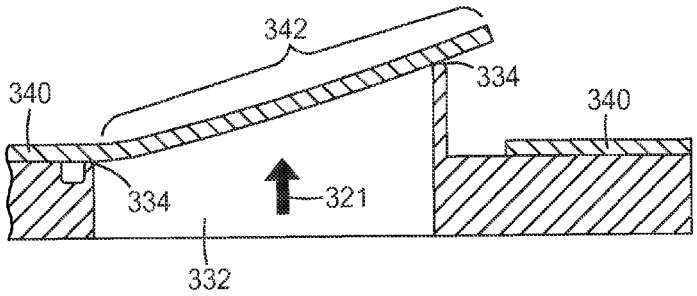
FIG. 11 is a cross-sectional view of a biased valve flap and the curved seal surface against which the biased valve flap rests.

Examples and discussions of the potential advantages of biasing valve flaps against seal surfaces may be found in, e.g., U.S. Pat. Nos. 5,509,436 and 5,325,892 to Japuntich et al. In general, biasing valve flaps against seal surfaces is more commonly associated with valve flaps (and diaphragms) that are made of more flexible materials capable of conforming to the shape of the seal surface. One example, as depicted in FIG. 11, of a non-planar seal surface 334 that may be advantageously used when a valve flap 342 formed in a diaphragm 340 is biased into contact with the seal surface 334 by forcing the valve flap 342 into a non-planar (e.g., curved) configuration that corresponds to the shape of the seal surface 334. In response to air flow through the opening 332 in the direction of arrow 321, the valve flap 342 preferably moves away from the seal surface 334 in the direction of arrow 321. In the absence of such air flow, the valve flap 342 preferably returns to the position seen in FIG. 11 in which the flap 342 seals against the seal surface 334.

Figure 12:
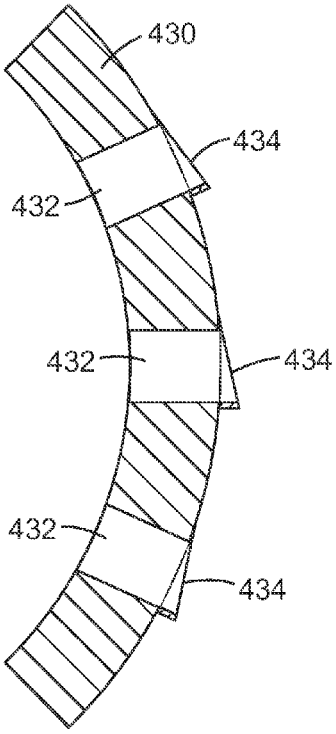
FIG. 12 is a side cross-sectional view of an alternative embodiment in which the base is curved and the planar seal surfaces are located in different planes.

Another potential variation in the unidirectional valves of the present invention is depicted in the cross-sectional view of FIG. 12 in which a plurality of planar seal surfaces 434 are arranged on a base 430 such that the planar seal surfaces 434 do not lie in the same plane. This is in contrast with, e.g., the planar seal surfaces 34 in the base 30 depicted in FIG. 3—all of which are located in the same plane. One potential advantage of providing planar seal surfaces that do not lie in the same plane is that the base 430 carrying the planar seal surfaces can have a curvature that may allow the base 430 (and the corresponding valve formed therewith) to more closely conform to the shape of a face mask on which the unidirectional valve is used. That more conformal shape may help to further reduce the profile of the unidirectional valve on the face mask.

Figure 13:
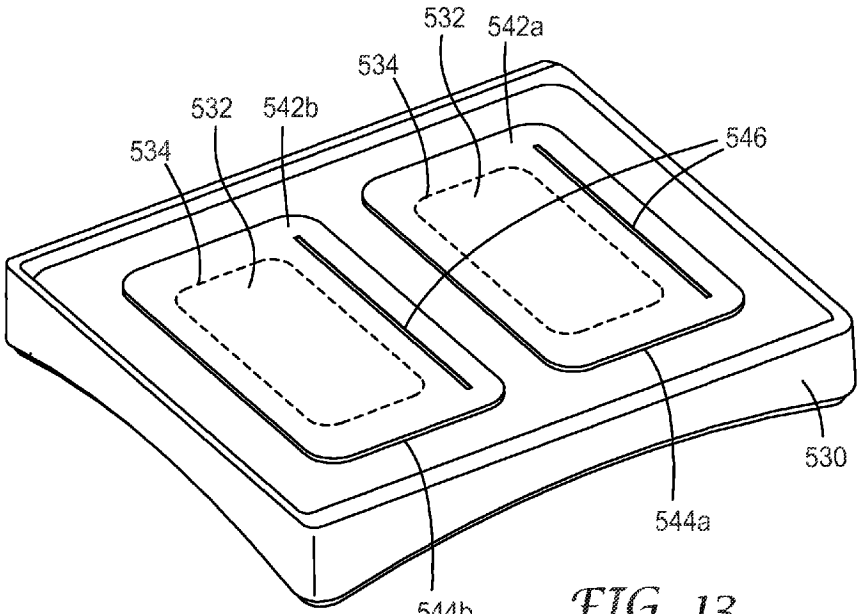
FIG. 13 is a perspective view of a portion of an alternative embodiment of a unidirectional valve for use in connection with the present invention.

Still other embodiments of unidirectional valves that may be used in connection with the present invention can be described with respect to FIG. 13, which is a perspective view depicting a base 530 on which two separate valve flaps 542*a* and 542*b* are positioned. Each of the valve flaps 542*a* and 542*b* is located over an opening 532 in the base 530 that includes a surrounding seal surface 534 (depicted in broken lines in FIG. 13) to seal the opening as discussed herein. Among the differences in the construction of the unidirectional valve depicted in FIG. 13 and the valves described above is that each of the valve flap 542*a* and 542*b* is separate and distinct from the other. In other words, there is common diaphragm that connects both of the valve flaps 542*a* and 542*b*.

Although not depicted in FIG. 13, the unidirectional valves that include multiple valve flaps may also include a cover attached to the base (as depicted and described in connection with the embodiments described above). The valve flaps may preferably be located between the cover and the base. Any such cover may preferably include a vent structure for each opening of the two or more openings, wherein each vent structure defines a distinct flow path through the cover for gas passing through each of opening of the two or more openings as discussed above. In addition, for each valve flap in the valve, the vent structure may include a louver that comprises an edge positioned to retain a valve flap in proximity with the base. Further, each vent structure may include a main vent located opposite the opening and a side vent located to one side of the opening.

The valve flaps 542*a* and 542*b* each include a hinge 546 that separates a stationary portion of the valve flap from a movable portion of the valve flap. The stationary portions of the valve flaps 542*a* and 542*b* are preferably located outside of the bounds of the seal surfaces, while the movable portions of the valve flaps 542*a* and 542*b* are preferably those portions that are positioned over the seal surfaces 534 to close or seal the openings 532 during use of the valve.

As depicted, each of the hinges 546 includes optional structure in the form of one or more slots formed through the valve flap and one or more land portions through which the movable portion of the valve flap is connected to the stationary portion of the valve flap. It may be preferred that, as depicted, the one or more hinge slots are located outside of the bounds of the seal surface that surrounds the opening when the valve flap is in the closed position.

Another feature depicted in FIG. 13 is that the valve flaps 542*a* and 542*b* are oriented in the same direction such that the valve flap hinges 546 are generally parallel to each other (where generally parallel does not require absolute parallelism) and where the free edge of at least one of the valve flaps is located adjacent the hinge of another valve flap (which, in the embodiment depicted in FIG. 13 means that the free edge 544*a* of the valve flap 542*a* is located adjacent the hinge 546 of the other valve flap 542*b*). One potential advantage of orienting the valve flaps in the same direction is that, when open, all of the valve flap openings face the same direction such that air passing through the open valve flaps is generally passed in the same direction—for example, away from the eyes of a wearer.

Also, although the valve structure depicted in FIG. 13 includes two valve flaps, the unidirectional valves of the present invention may include only one valve flap in some embodiments.

The following discussions will address materials and other features that may optionally be included in the face masks of the present invention.

Seal Surface Considerations:

Depending on a variety of factors, the seal surfaces used in connection with the present invention may be rigid or resilient, depending on the design of the unidirectional valve as a whole.

Some examples of rigid seal surfaces, suitable materials for the same, and some potentially suitable flap considerations may be described in U.S. Patent Application Publication No. US 2007/0144524 A1 (Martin).

Briefly, however, the materials used to form rigid seal surfaces in unidirectional valves of the present invention may preferably have a hardness of more than 0.02 GPa. It may be preferred that the rigid seal surfaces be constructed of materials that exhibit a hardness of 0.05 GPa or higher. The hardness may be determined in accordance with the "Nanoindentation Technique" set forth herein.

The rigid seal surface may be formed as an integral part of the base. Alternatively, a rigid seal surface meeting the hardness requirements discussed herein could be attached to a base using essentially any technique suitable for doing so, such as adhering, bonding, welding, frictionally engaging, two-shot injection molding, etc. The seal surface may be, e.g., in the form of a coating, a film, a ring, etc.

It may be preferred that the base and rigid seal surface be formed as an integral unit from a relatively lightweight plastic that is molded into an integral one-piece body using, for example, injection molding techniques and the rigid seal surface would be joined to it. The contact area of the seal surface preferably has a width great enough to form a seal with a valve flap, but is not so wide as to allow adhesive forces—caused by condensed moisture or expelled saliva—make the valve flap significantly more difficult to open. The width of the rigid seal or contact surface may, in some embodiments, be at least about 0.2 mm, and possibly about 0.25 mm to about 0.5 mm.

Examples of some potentially suitable materials from which the rigid seal surfaces may be made include highly crystalline materials such as ceramics, diamond, glass, zirconia; metals/foils from materials such as boron, brass, magnesium alloys, nickel alloys, stainless steel, steel, titanium, and tungsten. Polymeric materials that may be suitable include thermoplastics such as copolyester ether, ethylene methyl acrylate polymer, polyurethane, acrylonitrile-butadiene styrene polymer, high density polyethylene, high impact polystyrene, linear low density polyethylene, polycarbonate, liquid crystal polymer, low density polyethylene, melamines, nylon, polyacrylate, polyamide-imide, polybutylene terephthalate, polycarbonate, polyetheretherketone, polyetherimide, polyethylene napthalene, polyethylene terephthalate, polyimide, polyoxymethylene, polypropylene, polystyrene, polyvinylidene chloride, and polyvinylidene fluoride. Naturally-derived cellulosic materials such as reed, paper, and woods like beech, cedar, maple, and spruce may also be useful. Blends, mixtures, and combinations of these materials may too be used. Examples of some potentially suitable commercially available materials for the seal surface may include those materials described in Table 1 of U.S. Patent Application Publication No. US 2007/0144524 (Martin).

As one alternative to unidirectional valves with rigid seal surfaces, the unidirectional valves of the present invention may, in some embodiments, include resilient seal surfaces. Unidirectional valves with resilient seal surfaces and the flaps that may be advantageously used with the resilient seal surfaces may be described in, e.g., U.S. Pat. No. 7,188,622 (Martin et al.).

The resilient seal surfaces used in conjunction with unidirectional valves in face masks of the present invention may preferably recover if deformed during use and have a hardness of less than about 0.02 GPa. Preferably, the resilient seal surfaces may have a hardness of less than about 0.015 GPa, and more preferably a hardness less than about 0.013 GPa, and still more preferably, a hardness of less than about 0.01 GPa. In some embodiments, the resilient seal surfaces may have a hardness of about 0.006 GPa to about 0.001 GPa. The hardness could still be less than 0.001 GPa, provided the surface recovers when deformed. The hardness may be determined in accordance with the "Nanoindentation Technique" set forth below.

The resilient seal surface may be secured to the base of the valve using essentially any technique suitable for doing so, such as adhering, bonding, welding, frictionally engaging, etc. Alternatively, the seal surface could be fashioned as an "integral" part of the base, that is, the base and the resilient seal surface it may be fashioned as a single unit and not two separate parts that were subsequently joined together (two-shot injection molding may, for example, provide a useful method of making the base and resilient seal surface from different materials). The seal surface may, e.g., be in the form of a coating, a film, a ring such as an O-ring, or a foam such as a cellular, closed cell foam. It may, however, be preferred that the majority of the valve base be made from a relatively lightweight plastic that is molded into an integral one-piece body using, for example, injection molding techniques and the resilient seal surface would be joined to that base.

Examples of materials from which the resilient seal surfaces may be made, include those that would promote a good seal between a valve flap and the seal surface. These materials may generally include elastomers, both thermoset and thermoplastic; and thermoplastic/plastomers.

Elastomers, which may be either thermoplastic elastomers or crosslinked rubbers, may include rubber materials such as polyisoprene, poly (styrene-butadiene) rubber, polybutadiene, butyl rubber, ethylene-propylene-diene rubber, ethylene-propylene rubber, nitrile rubber, polychloroprene rubber, chlorinated polyethylene rubber, chlorosulphonated polyethylene rubber, polyacrylate elastomer, ethylene-acrylic rubber, fluorine containing elastomers, silicone rubber, polyurethane, epichlorohydrin rubber, propylene oxide rubber, polysulphide rubber, polyphosphazene rubber, and latex rubber, styrene-butadiene-styrene block copolymer elastomer, styrene-ethylene/butylene-styrene block copolymer elastomer, styrene-isoprene-styrene block copolymer elastomer, ultra low density polyethylene elastomer, copolyester ether elastomer, ethylene methyl acrylate elastomer ethylene vinyl acetate elastomer, and polyalphaolefin elastomers. Blends or mixtures of these materials may also be used. Examples of some commercially available polymeric materials that may potentially be used for the resilient seal surfaces include those materials described in Table 1 of U.S. Pat. No. 7,028,689 (Martin et al.).

Diaphragm/Valve Flap Considerations:

The diaphragms (and the valve flaps formed in them) used in the unidirectional valves of the present invention may be manufactured in a wide variety of forms using a wide variety of materials. Regardless of the specifics, the valve flaps formed in the diaphragms used in the unidirectional valves of the present invention preferably bend or deform dynamically to open in response to pressure in one direction and readily return to the closed position when that pressure falls below a selected level.

The valve flaps are preferably constructed such that, unless opened in response to air pressure, the valve flaps remain in the closed position regardless of the orientation of the valve. The valve flaps preferably do not pull away from the seal surfaces even if the valve flaps are below the seal surfaces such that the force of gravity is acting on the flaps to pull them away from the seal surfaces. For example, the valve flaps are preferably capable of remaining in the closed position when a wearer bends their head downward towards the floor, etc. (unless the wearer is exhaling if the valve is an exhalation valve).

In terms of physical form, it may be preferred that the diaphragms and valve flaps be manufactured from sheet materials that have two opposing major surfaces and a relatively thin thickness as measured between the major surfaces. Those sheet materials can be manufactured by any suitable technique, e.g., extrusion, electroplating, injection molding, casting, solvent coating, vapor deposition, etc. The valve flaps may typically be formed in such diaphragm sheet materials by a variety of techniques such as, e.g., laser slitting, water jet cutting, electron discharge machining, die cutting, etc.

The diaphragms and valve flaps may alternatively be provided as articles that are not formed in sheets. The valve flaps may be formed in such diaphragms at the time the diaphragms are, themselves, manufactured or the valve flaps may be formed after the diaphragms are manufactured (as with the sheet-based diaphragms). Diaphragms and valve flaps that are not formed from sheet materials may be manufactured by any suitable technique, e.g., electroplating, injection molding, casting, solvent coating, vapor deposition, stamping, etc.

As with the physical form, the diaphragms may also be manufactured from materials that that exhibit a wide variety of physical characteristics. As discussed herein, the valve flaps may be biased against the seal surfaces or unbiased against the seal surfaces.

If the valve is to include biased valve flaps, the diaphragm materials may preferably be softer or more resilient. Examples of materials and constructions that may be suitable for biased valve flaps may be described in, e.g., U.S. Pat. Nos. 5,509,436 and 5,325,892 to Japuntich et al., as well as in U.S. Pat. No. 7,028,689 to Martin et al.

If the valve flaps are to be unbiased against the seal surfaces, it may be preferred that the valve flaps be stiffer than those used in connection with biased valve flaps. The increased stiffness in unbiased valve flaps is preferably sufficient to achieve an acceptable seal with the seal surfaces in the absence of any significant pre-stress or bias towards the seal surface. The lack of significant predefined stress or force on the flap, to ensure that it is pressed against the seal surface during valve closure under neutral conditions, can potentially enable the flap to open more easily and, hence, can reduce the power needed to operate the valve while breathing.

Further, the materials for the diaphragm/valve flaps, while stiff, preferably deform elastically over the actuation range of the valve flap. The diaphragms and valve flaps may be monolayer constructions or they may be multilayer constructions in which two or more layers are combined to provide desired physical characteristics to the resulting composite structure. Potentially suitable materials and valve flap constructions that may be used to provide unbiased valve flaps may be described in, e.g., U.S. Pat. No. 7,188,622 (Martin et al.); U.S. Pat. No. 7,013,895 (Martin et al.); and U.S. Patent Application Publication No. US 2007/0144524 (Martin).

In one manner of characterizing stiffness in connection with the diaphragms and valve flaps of the invention, the stiffness may be described as a function of the modulus of elasticity of the materials used in the diaphragms and valve flaps. The "modulus of elasticity" is the ratio of the stress-to-strain for the straight-line portion of the stress-strain curve, which curve is obtained by applying an axial load to a test specimen and measuring the load and deformation simultaneously. Typically, a test specimen is loaded uniaxially and load and strain are measured, either incrementally or continuously. The modulus of elasticity for materials employed in the invention may be obtained using a standardized ASTM test. The ASTM tests employed for determining elastic or Young's modulus are defined by the type or class of material that is to be analyzed under standard conditions. A general test for structural materials is covered by ASTM E111-97 and may be employed for structural materials in which creep is negligible, compared to the strain produced immediately upon loading and to elastic behavior. The standard test method for determining tensile properties of plastics is described in ASTM D638-01 and may be employed when evaluating unreinforced and reinforced plastics. If a vulcanized thermoset rubber or thermoplastic elastomer is selected for use in the invention, then standard test method ASTM D412-98a, which covers procedures used to evaluate the tensile properties of these materials, may be employed.

Flexural modulus is another property that may be used to define the material used in the layers of the flexible flap. For plastics, flexural modulus may be determined in accordance with standardized test ASTM D747-99.

Modulus values convey intrinsic material properties and not precisely-comparable composition properties. This is especially true when dissimilar classes of materials are employed in a flap. If different classes of materials are employed in a flap, then the skilled artisan will need to select the test that is most appropriate for the combination of materials. For example, if a flap contains a ceramic powder (a discontinuous phase) in a polymer (a continuous phase or matrix), the ASTM test for plastics would probably be the more suitable test method if the plastic portion was the continuous phase in the flap.

The thickness of the valve flaps may be chosen in view of the modulus of elasticity to provide sufficient stiffness to the valve flaps. For example, if the materials used to construct the diaphragm (and valve flaps formed therein) have a higher modulus of elasticity, then the diaphragm may be thinner so that the force required to open the valve flaps is at an acceptable level. Conversely, if the materials used to construct the diaphragm have a lower modulus of elasticity, it may be advantageous to provide a thicker diaphragm to ensure that the unbiased valve flaps provide acceptable sealing in all orientations. For example, in some embodiments the lower end of potentially acceptable modulus of elasticity for the diaphragm and valve flap materials may preferably be about 0.7 MPa (MegaPascals) or higher, or about 0.8 MPa or higher, or about 2 MPa or higher. At the upper end of the range, the modulus of elasticity for some potentially suitable diaphragm and valve flap materials may be about $1.1\times10^6$ MPa or less, or about 11,000 MPa or less, or even 5,000 MPa or less.

Some potentially suitable diaphragm and valve flap materials that may be on the lower end of the modulus of elasticity range may include resilient polymeric materials. As the term is used in this document, "polymeric" means containing a polymer, which is a molecule that contains repeating units, regularly or irregularly arranged. The polymer may be natural or synthetic and preferably is organic. Resilient polymeric materials may include elastomers, thermoset and thermoplastic, and plastomers, or blends thereof. The polymeric materials in the diaphragm and valve flaps may or may not be oriented, either in their entireties or in part.

Potentially suitable elastomers, which may be either thermoplastic elastomers or crosslinked rubbers, may include rubber materials such as polyisoprene, poly (styrene-butadiene) rubber, polybutadiene, butyl rubber, ethylene-propylene-diene rubber, ethylene-propylene rubber, nitrile rubber, polychloroprene rubber, chlorinated polyethylene rubber, chlorosulphonated polyethylene rubber, polyacrylate elastomer, ethylene-acrylic rubber, fluorine containing elastomers, silicone rubber, polyurethane, epichlorohydrin rubber, propylene oxide rubber, polysulphide rubber, polyphosphazene rubber, and latex rubber, styrene-butadiene-styrene block copolymer elastomer, styrene-ethylene/butylene-styrene block copolymer elastomer, styrene-isoprene-styrene block copolymer elastomer, ultra low density polyethylene elastomer, copolyester ether elastomer, ethylene methyl acrylate elastomer ethylene vinyl acetate elastomer, and polyalphaolefin elastomers. Blends or mixtures of these materials may also be used. Materials that may be blended with those discussed above may include, for example, polymers, fillers, additives, stabilizers, and the like. Examples of some potentially suitable materials for the diaphragms and flaps on the lower end of the modulus of elasticity range may be described in Table 2 of U.S. Patent Application Publication No. US 2007/0144524 (Martin).

Some potentially suitable diaphragm and valve flap materials that may be on the higher end of the modulus of elasticity range may include highly crystalline materials such as ceramics, diamond, glass, zirconia; metals/foils from materials such as boron, brass, magnesium alloys, nickel alloys, stainless steel, steel, titanium, and tungsten. Polymeric materials that may be suitable include thermoplastics such as copolyester ether, ethylene methyl acrylate polymer, polyurethane, acrylonitrile-butadiene styrene polymer, high density polyethylene, high impact polystyrene, linear low density polyethylene, polycarbonate, liquid crystal polymer, low density polyethylene, melamines, nylon, polyacrylate, polyamide-imide, polybutylene terephthalate, polycarbonate, polyetheretherketone, polyetherimide, polyethylene napthalene, polyethylene terephthalate, polyimide, polyoxymethylene, polypropylene, polystyrene, polyvinylidene chloride, and polyvinylidene fluoride. Naturally-derived cellulosic materials such as reed, paper, and woods like beech, cedar, maple, and spruce may also be useful. Blends, mixtures, and combinations of these or other materials may also be used. Examples of some commercially available materials that may be suitable for the second stiffer layer are described in Table 2 of U.S. Pat. No. 7,013,895 (Martin et al.).

Still another manner in which the diaphragm and valve flap material may be characterized is a cantilever bend ratio value that can be determined according to the Cantilever Bending Ratio test described below. This characterization may be more appropriate if the material used for the diaphragm is sheet stock such that a proper test specimen can be obtained to determine the cantilever bending ratio. The combination of modulus of elasticity and thickness of the material used for the diaphragms and unbiased valve flaps may preferably result in relatively low Cantilever Bend Ratios. It may be preferred that the diaphragm and valve flap material, although flexible, exhibit cantilever bend ratios of about 0.0050 or less, more preferably about 0.0025 or less, and potentially more preferably about 0.0015 or less.

As discussed above, the thickness of the diaphragms and valve flaps may be selected to obtain the desired physical characteristics that result in proper operation of the unidirectional valves. As exemplary values only, the thickness of the diaphragms and valve flaps may be about 10 micrometers (μm) to about 2000 μm, preferably about 20 μm to about 700 μm, and more preferably about 25 μm to about 600 μm—although it should be understood that diaphragms and valve flaps with thicknesses outside of these ranges may also still fall within the scope of the present invention.

Face Mask Constructions:

The face masks including unidirectional valves of the present invention may take a variety of forms, including, e.g., half and full face masks and hoods. As discussed herein, the unidirectional valves may be used as either inhalation or exhalation valves in connection with the face masks.

FIG. 1 illustrates one exemplary face mask with which the unidirectional valve flaps described herein may be used. In the depicted embodiment, mask body 12 is adapted to fit over the nose and mouth of a person in spaced relation to the wearer's face to create an interior gas space or void between the wearer's face and the interior surface of the mask body. The mask body 12 may, in some embodiments, be a filtering mask body that is, itself, fluid permeable and used to filter air entering the interior gas space through the mask body itself. A filtering mask body may typically be provided with an opening (not shown) that is located where the unidirectional exhalation valve 20 is attached to the mask body 12 so that exhaled air can exit the interior gas space through the valve 20 without having to pass through the mask body 12. If the mask body 12 is fluid permeable, it may be constructed of multiple layers of materials as described in, e.g., U.S. Pat. No. 7,028,689 to Martin et al.

One potentially preferred location for an exhalation valve opening on the mask body 12 is directly in front of where the wearer's mouth would be when the mask is being worn. The placement of the opening, and hence the valve 20, at this location allows the valve to open more easily in response to the exhalation pressure generated by a wearer of the mask 10. For a mask body 12 of the type shown in FIG. 1, essentially the entire exposed surface of mask body 12 may be fluid permeable to inhaled air.

Mask body 12 can have a curved, hemispherical shape as shown in FIG. 1 (see also U.S. Pat. No. 4,807,619 to Dyrud et al.) or it may take on other shapes as so desired. For example, the mask body can be a cup-shaped mask having a construction like the face mask disclosed in U.S. Pat. No. 4,827,924 to Japuntich. The mask also could have the three-fold configuration that can fold flat when not in use but can open into a cup-shaped configuration when worn—see U.S. Pat. No.

6,123,077 to Bostock et al., as well as U.S. Pat. Nos. Des. 431,647 to Henderson et al. and Des. 424,688 to Bryant et al. Face masks of the invention also may take on many other configurations, such as flat bifold masks disclosed in U.S. Pat. No. Des. 443,927 to Chen. The mask body also could be fluid impermeable and have filter cartridges attached to it like the mask shown in U.S. Pat. No. 5,062,421 to Burns and Reischel.

In addition, the mask body also could be adapted for use with a positive pressure air intake as opposed to the negative pressure masks just described. Examples of positive pressure masks are shown in U.S. Pat. No. 5,924,420 to Grannis et al. and U.S. Pat. No. 4,790,306 to Braun et al. The mask body of the filtering face mask also could be connected to a self-contained breathing apparatus, which supplies clean air to the wearer as disclosed, for example, in U.S. Pat. Nos. 5,035,239 and 4,971,052.

The mask body may be configured to cover not only the nose and mouth of the wearer (referred to as a "half mask") but may also cover the eyes (referred to as a "full face mask") to provide protection to a wearer's vision as well as to the wearer's respiratory system—see, for example, U.S. Pat. No. 5,924,420 to Reischel et al. The mask body may be spaced from the wearer's face, or it may reside flush or in close proximity to it. In either instance, the mask helps define an interior gas space into which exhaled air passes before leaving the mask interior through the exhalation valve. The mask body also could have a thermochromic fit-indicating seal at its periphery to allow the wearer to easily ascertain if a proper fit has been established—see U.S. Pat. No. 5,617,849 to Springett et al.

To hold the face mask snugly upon the wearer's face, mask body can have a harness such as straps 15, tie strings, or any other suitable means attached to it for supporting the mask on the wearer's face. Examples of mask harnesses that may be suitable are shown in U.S. Pat. Nos. 5,394,568, and 6,062,221 to Brostrom et al., and U.S. Pat. No. 5,464,010 to Byram.

A nose clip 16 that includes a pliable dead soft band of metal such as aluminum can be provided on mask body 12 to allow it to be shaped to hold the face mask in a desired fitting relationship over the nose of the wearer. An example of one suitable nose clip is shown in U.S. Pat. Nos. 5,558,089 and Des. 412,573 to Castiglione.

Test Apparatus and Methods

Hardness Measurement:

A Nanoindentation Technique was employed to determine hardness of materials used in valve seats. The Nanoindentation Technique permitted testing of either raw material specimens, for use in seal surface applications, or seal surfaces as they were incorporated as part of a valve assembly. This test was carried out using a microindentation device, MTS Nano XP Micromechanical Tester available from MTS Systems Corp., Nano Instruments Innovation Center 1001 Larson Drive, Oak Ridge Tenn., 37839. Using this device, the penetration depth of a Berkovich pyramidal diamond indenter, having a 65 degree included half cone angle was measured as a function of the applied force, up to the maximum load. The nominal loading rate was 10 nanometers per second (nm/s) with a surface approach sensitivity of 40% and a spatial drift setpoint set at 0.8 nm/s maximum. Constant strain rate experiments to a depth of 5,000 nm were used for all tests with the exception of fused silica calibration standards, in which case a constant strain rate to a final load of 100,000 micro Newtons was used. Target values for the strain rate, harmonic displacement, and Poissons Ratio were 0.05 $sec^{-1}$, 45 Hertz, and 0.4, respectively. With the test specimen fixed in a holder, the target surface to be tested was located from a top-down view through a video screen of the device. The test regions were selected locally with 100× video magnification of the test apparatus to ensure that tested regions are representative of the desired sample material, that is, free of voids, inclusions, or debris. In the test procedure, one test is conducted for the fused quartz standard for each experimental run as a 'witness'. Axis alignment between the microscope optical axis and the indenter axis is checked and calibrated previous to testing by an iterative process where test indentations are made into a fused quartz standard, with error correction provided by software in the test apparatus. The test system was operated in a Continuous Stiffness Measurement (CSM) mode. Hardness, reported in Mega Pascals (MPa) or Giga Pascals (GPa), is defined as the threshold contact stress for the onset of plastic flow of the specimen and is given as:

H=Hardness

P=Load

A=Contact Area

Cantilever Bending Ratio:

A cantilever bending test can be used to indicate stiffness of thin strips of material by measuring the bending length of a specimen under its own mass. A test specimen is prepared by cutting the 0.794 cm wide strips of material to approximately 5 cm lengths. The specimen is slid, in a direction parallel to its long dimension, over the 90° edge of a horizontal surface. After 1.5 cm of material extends past the edge (the extended length), the deflection of the specimen is measured as the vertical distance from the lowermost edge at the end of the strip to the horizontal surface. The deflection of the specimen divided by its extended length is reported as the cantilever bend ratio. A cantilever bend ratio approaching one (1) would indicate a higher level of flexibility than a cantilever bend ratio that approaches zero.

The complete disclosure of the patents, patent documents, and publications cited herein are incorporated by reference in their entirety as if each were individually incorporated.

Exemplary embodiments of this invention have been discussed and reference has been made to possible variations within the scope of this invention. These and other variations and modifications in the invention will be apparent to those skilled in the art without departing from the scope of the invention, and it should be understood that this invention is not limited to the illustrative embodiments set forth herein. Accordingly, the invention is to be limited only by the claims provided below and equivalents thereof.

The invention claimed is:

1. A face mask that comprises:

a mask body adapted to fit over at least the nose and mouth of a person to help define an interior gas space when worn; and a unidirectional valve that permits fluid communication between the interior gas space and an exterior gas space, wherein the unidirectional valve comprises:

a base attached to the mask body, the base comprising two or more openings through which gas may pass between the interior gas space and the exterior gas space, wherein each opening of the two or more openings is surrounded by a seal surface that extends around the opening;

a stationary diaphragm positioned on the base, wherein the diaphragm extends over the two or more openings and their respective seal surfaces;

two or more valve flaps formed within the diaphragm, wherein each valve flap of the two or more valve flaps is located over one of the two or more openings, and wherein each valve flap of the two or more valve flaps comprises a boundary slot formed through the diaphragm and a hinge along which the valve flap is attached to the diaphragm, wherein the boundary slot defines a free edge of the valve flap that extends from a first end to a second end and wherein the hinge extends between the first end and the second end of the free edge of the valve flap; and wherein each valve flap of the two or more valve flaps exhibits a cantilever bend ratio of 0.0050 or less and has a thickness of 10 to 2000 micrometers and comprises a closed position in which the valve flap contacts the seal surface and remains in contact with seal surface regardless of the orientation of the unidirectional valve, and wherein the valve flap also comprises an open position in which at least a portion of the valve flap is lifted off of the seal surface such that gas may pass between the interior gas space and the exterior gas space.

2. A face mask according to claim 1, wherein the boundary slot for each valve flap of the two or more valve flaps comprises a slot width such that the free edge of the valve flap is spaced from an opposing edge of the diaphragm across the boundary slot.

3. A face mask according to claim 1, wherein the hinge of at least one of the valve flaps comprises a score line formed into the diaphragm.

4. A face mask according to claim 1, wherein the hinge of at least one of the valve flaps comprises one or more hinge slots formed through the diaphragm, and one or more land portions connecting the valve flap to the diaphragm.

5. A face mask according to claim 1, wherein the two or more valve flaps located over the two or more openings are oriented in the same direction such that the free edge of one valve flap is located adjacent the hinge of the other valve flap and wherein the hinges of the valve flaps are generally parallel to each other.

6. A face mask according to claim 1, wherein each opening is surrounded by a planar seal surface, and wherein the planar seal surfaces that extend around each opening of the two or more openings are located in the same plane.

7. A face mask according to claim 1, wherein each seal surface comprises a planar seal surface, and wherein the planar seal surfaces that extend around each opening of the two or more openings are located in different planes.

8. A face mask according to claim 1, wherein each valve flap of the two or more valve flaps is unbiased against its seal surface when in the closed position.

9. A face mask according to claim 1, wherein each valve flap of the two or more valve flaps is biased against its seal surface when the valve flap is in the closed position.

10. A face mask according to claim 1, wherein the seal surface that extends around each opening of the two or more openings comprises a resilient seal surface.

11. A face mask according to claim 1, wherein the mask body comprises a filtering mask body, and wherein the unidirectional valve comprises an exhalation valve.

12. A face mask according to claim 1, wherein the unidirectional valve further comprises a cover attached to the base, wherein the diaphragm is located between the cover and the base, wherein the cover comprises a vent structure for each opening of the two or more openings, wherein each vent structure defines a distinct flow path through the cover for gas passing through each of opening of the two or more openings.

13. A face mask according to claim 12, wherein, for each valve flap in the diaphragm, the vent structure comprises a louver that comprises an edge positioned to retain the diaphragm in proximity with the base.

14. A face mask according to claim 12, wherein each vent structure comprises a main vent located opposite the opening and a side vent located to one side of the opening.

15. A face mask that comprises:

a mask body adapted to fit over at least the nose and mouth of a person to help define an interior gas space when worn; and a unidirectional valve that permits fluid communication between the interior gas space and an exterior gas space, wherein the unidirectional valve comprises:

a base attached to the mask body, the base comprising at least two openings through which gas may pass between the interior gas space and the exterior gas space, wherein each opening of the at least two openings is surrounded by a seal surface that extends around the opening;

first and second valve flaps located respectively over each of the at least two openings, and wherein each of the first and second valve flaps comprises a stationary portion and a movable portion, wherein a hinge is located between the stationary portion and the movable portion, and wherein each valve flap comprises a free edge extending around the movable portion of the valve flap outside of the hinge; and wherein each valve flap exhibits a cantilever bend ratio of 0.0050 or less and has a thickness of 10 to 2000 micrometers and comprises a closed position in which the movable portion of the valve flap contacts the seal surface and remains in such contact regardless of the orientation of the valve, and wherein the each valve flap also comprises an open position in which the movable portion of the valve flap is lifted off of the seal surface such that gas may pass between the interior gas space and the exterior gas space; and and further wherein the first and second valve flaps that are located over the at least two openings are oriented in the same direction such that the free edge of the first valve flap is located adjacent the hinge of the second valve flap and wherein the hinges of the first and second valve flaps are generally parallel to each other.

16. A face mask according to claim 15, wherein the hinge of at least one of the first and second valve flaps comprises a score line.

17. A face mask according to claim 15, wherein the hinge of at least one of the first and second valve flaps comprises one or more hinge slots formed through the valve flap, and one or more land portions through which the movable portion of the first and/or second valve flap is connected to stationary portion of the first and/or second valve flap.

18. A face mask according to claim 15, wherein each seal surface comprises a planar seal surface, and wherein each of the planar seal surfaces that extends around each opening of the at least two or more openings is located in the same plane.

19. A face mask according to claim 15, wherein each seal surface comprises a planar seal surface, and wherein each of the planar seal surfaces that extends around each opening of the at least two openings is located in a different planes.

20. A face mask according to claim 15, wherein each valve flap of the first and second valve flaps is unbiased against its seal surface when in the closed position.

21. A face mask according to claim 15, wherein each valve flap of the first and second valve flaps is biased against its seal surface when the valve flap is in the closed position.

22. A face mask according to claim 15, wherein the seal surface that extends around each opening of the at least two openings comprises a resilient seal surface.

23. A face mask according to claim 15, wherein the mask body comprises a filtering mask body, and wherein the unidirectional valve comprises an exhalation valve.

24. A face mask according to claim 15, wherein the unidirectional valve further comprises a cover attached to the base, wherein the first and second valve flaps are located between the cover and the base, wherein the cover comprises a vent structure for each opening of the at least two openings, wherein each vent structure defines a distinct flow path through the cover for gas passing through each of opening of the at least two openings.

25. A face mask according to claim 24, wherein, for each of the first and second valve flaps, the vent structure comprises a louver that comprises an edge positioned to retain the respective valve flap in proximity with the base.

26. A face mask according to claim 24, wherein each vent structure comprises a main vent located opposite the opening and a side vent located to one side of the opening.

* * * * *

UNITED STATES PATENT AND TRADEMARK OFFICE

CERTIFICATE OF CORRECTION

PATENT NO. : 8,757,156 B2
APPLICATION NO. : 12/250059
DATED : June 24, 2014
INVENTOR(S) : Martin et al.

It is certified that error appears in the above-identified patent and that said Letters Patent is hereby corrected as shown below:

In the Specification

Column 16
Line 10, delete "napthalene," and insert -- naphthalene, --, therefor.

Column 17
Line 56, delete "that that" and insert -- that --, therefor.

Column 19
Line 61, delete "napthalene," and insert -- naphthalene, --, therefor.

In the Claims

Column 23
Line 11, in Claim 1, after "with" insert -- the --.

Column 24
Lines 35-36, in Claim 15, delete "and and" and insert -- and --, therefor.
Line 58, in Claim 19, delete "planes." and insert -- plane. --, therefor.

Signed and Sealed this
Fourth Day of November, 2014

Michelle K. Lee

Michelle K. Lee
*Deputy Director of the United States Patent and Trademark Office*